US011680418B2

(12) United States Patent
O'Connor et al.

(10) Patent No.: US 11,680,418 B2
(45) Date of Patent: Jun. 20, 2023

(54) ASSEMBLY FOR ERECTING AND DISMANTLING A COMMON TOWER ADJACENT A BUILDING STRUCTURE AND A METHOD OF ERECTING AND DISMANTLING THE SAME

(71) Applicant: DHS FRACO LLC, Sunnyside, NY (US)

(72) Inventors: Brian O'Connor, Elkridge, MD (US); John O'Connor, Elkridge, MD (US)

(73) Assignee: DHS FRACO LLC, Sunnyside, NY (US)

( * ) Notice: Subject to any disclaimer, the term of this patent is extended or adjusted under 35 U.S.C. 154(b) by 0 days.

(21) Appl. No.: 17/182,865

(22) PCT Filed: Aug. 28, 2018

(86) PCT No.: PCT/US2018/048228

§ 371 (c)(1),
(2) Date: Feb. 23, 2021

(87) PCT Pub. No.: WO2020/046272

PCT Pub. Date: Mar. 5, 2020

(65) Prior Publication Data

US 2021/0293040 A1 Sep. 23, 2021

(51) Int. Cl.

| | |
|---|---|
| ***E04G 21/32*** | (2006.01) |
| ***E04B 1/18*** | (2006.01) |
| ***E04B 1/35*** | (2006.01) |

(52) U.S. Cl.

CPC ..... *E04G 21/32* (2013.01); *E04B 1/18* (2013.01); *E04B 1/3511* (2013.01)

(58) Field of Classification Search

CPC ... E04G 21/32; E04G 1/12; E04B 1/18; E04B 1/3511; B66F 11/04; A47B 96/02; E04C 5/03; E04H 12/085

(Continued)

(56) References Cited

U.S. PATENT DOCUMENTS 3,451,183 A * 6/1969 Lespagnoljeanp ..... E06B 3/968 52/656.1
3,968,882 A * 7/1976 Mello ..... A47B 96/00 248/188.7

(Continued)

FOREIGN PATENT DOCUMENTS

EP 3239437 A1 * 11/2017

*Primary Examiner* — Paola Agudelo
(74) *Attorney, Agent, or Firm* — Patrick Stanzione; Stanzione & Associates, PLLC

(57) ABSTRACT

The present disclosure relates to a common tower configured to be erected adjacent a building structure into construction. The tower comprises spaced apart columns, made of vertically aligned column hollow sections, spacedly and substantially vertically positioned adjacent the building structure, and vertically spaced apart flooring structures releasably and slidably supported by the spaced apart columns using a plurality of sliders. Each flooring structure is being capable of vertical displacement when supported by the spaced apart columns. The tower further comprises an anchoring system adapted to securely engage with the building structure to maintain the spaced apart columns substantially upright, as well as protection structures adapted to surround the flooring structures. A safe and easy erection of the tower using a common tower assembly is described.

14 Claims, 36 Drawing Sheets

(58) Field of Classification Search
USPC ..... 52/852
See application file for complete search history.

(56) References Cited

U.S. PATENT DOCUMENTS

| | | | | | |
|---|---|---|---|---|---|
| 4,467,888 | A * | 8/1984 | Hickling | E04G 5/14 | 182/19 |
| 5,647,650 | A * | 7/1997 | Daugherty | A47B 67/04 | 312/265.5 |
| 5,884,725 | A * | 3/1999 | Reyland | E04G 1/20 | 182/136 |
| 5,988,317 | A * | 11/1999 | Riding | E04G 7/304 | 182/152 |
| 6,161,359 | A * | 12/2000 | Ono | E04G 1/14 | 52/646 |
| 6,814,184 | B1 * | 11/2004 | Blinn, Jr. | E04G 11/48 | 182/186.7 |
| 8,459,412 | B2 * | 6/2013 | Nickel | E04G 1/15 | 182/17 |
| 9,004,715 | B1 * | 4/2015 | Litke | F21S 2/005 | 362/218 |
| 9,200,443 | B2 * | 12/2015 | Marple | E04B 2/60 | |
| 9,790,980 | B2 * | 10/2017 | McCarthy | F16B 37/045 | |
| 2013/0175233 | A1 * | 7/2013 | Wu | A47B 47/045 | 211/183 |
| 2015/0001169 | A1 * | 1/2015 | Chen | A47B 87/0223 | 211/188 |
| 2016/0362284 | A1 * | 12/2016 | Haessler | B66F 11/04 | |
| 2019/0309532 | A1 * | 10/2019 | Buck | B66B 9/022 | |

* cited by examiner

ASSEMBLY FOR ERECTING AND DISMANTLING A COMMON TOWER ADJACENT A BUILDING STRUCTURE AND A METHOD OF ERECTING AND DISMANTLING THE SAME

TECHNICAL FIELD

The present disclosure relates to common towers configured to allow hoisting facilities to be installed adjacent and along building structures, providing transportation of personnel and materials into high-rise buildings under construction. More particularly, the present disclosure relates to assemblies for erecting and dismantling common towers adjacent high-rise buildings under construction and to methods of erecting and dismantling the same.

BACKGROUND

Common towers are well known in the art for allowing hoisting facilities, machines and/or equipment to be installed adjacent and along building structures, such as new building constructions and renovation projects, providing minimum interferences to the construction site itself. Such towers allow for transportation of personnel and materials into high-rise buildings under construction.

Hoisting facilities, machines and/or equipment of all types may be tied to and grouped around common tower structures. Usage of a common tower therefore maximizes access to the building structure while minimizing the number and size of access openings provided into the building under construction.

Common towers found in the art that are configured to receive up to six hoisting equipment, each comprises a heavy mast structure (up to 400-500 pounds for a 5 feet mast section) that is adapted to receive the numerous flooring structures as well as the hoisting equipment themselves.

There is therefore a need for mast-free lighter assemblies and components configured to easily/safely erect and dismantle common towers such as to provide easy/safe transportation of personnel and materials into high-rise buildings under construction.

SUMMARY

It is an object of the present disclosure to provide an assembly for erecting and dismantling a common tower adjacent a high-rise building structure into construction that overcomes or mitigates one or more disadvantages of known common towers and/or common tower assemblies or at least provides a useful alternative.

According to an embodiment, there is provided an assembly for erecting a common tower adjacent a building structure into construction, the assembly comprising:

spaced apart columns configured to be spacedly and substantially vertically positioned adjacent the building structure;

vertically spaced apart flooring structures configured to be releasably and slidably supported by the spaced apart columns, each flooring structure being configured to be capable of vertical displacement when supported by the spaced apart columns;

an anchoring system configured to be releasably connected to at least one of: the spaced apart columns and the vertically spaced apart flooring structures, the anchoring system being adapted to securely engage with the building structure to maintain the spaced apart columns substantially upright; and protection structures configured to be connected to at least one of: the spaced apart columns and the vertically spaced apart flooring structures, each one of the protection structures being adapted to surround one of the flooring structures.

According to another embodiment, there is provided the assembly as defined above, wherein each one of the spaced apart columns comprises:

a plurality of column hollow sections, each column hollow section being configured to be releasably connected to an adjacent one of the plurality of column hollow sections.

According to a further embodiment, there is provided the assembly as defined above, wherein each one of the spaced apart columns further comprises:

a plurality of column section-to-section connecting members, wherein each one of the plurality of column section-to-section connecting members is adapted to releasably engage one of the plurality of column hollow sections to the adjacent one of the plurality of column hollow sections.

According to yet another embodiment, there is provided the assembly as defined above, wherein each one the plurality of column hollow sections defines an inner surface, an outer surface and comprises spaced apart longitudinal grooves radially aligned and formed within the outer surface.

According to another embodiment, there is provided the assembly as defined above, wherein each one the plurality of column hollow sections further comprises spaced apart openings longitudinally aligned within each one of the spaced apart longitudinal grooves.

According to a further embodiment, there is provided the assembly as defined above, wherein each one of the plurality of column section-to-section connecting members comprises:

a hollow main body defining a main body outer surface; and apertures formed within the hollow main body.

According to yet another embodiment, there is provided the assembly as defined above, wherein the main body outer surface is adapted to interface with the inner surface of each one of the plurality of column hollow sections.

According to another embodiment, there is provided the assembly as defined above, wherein each one of the plurality of column hollow sections defines a section first end and a section second end, the assembly further comprising:

base members adapted to receive the section first end and the section second end of the plurality of column hollow sections, and therefore adapted to support the spaced apart columns.

According to a further embodiment, there is provided the assembly as defined above, further comprising pin-like members adapted to releasably connect the one of the plurality of column hollow sections to the adjacent one of the plurality of column hollow sections using one of the plurality of column section-to-section connecting members by introducing each pin-like member in two of the spaced apart openings and further in two of the apertures to provide an end-to-end releasable connection between the one of the plurality of column hollow sections and the adjacent one of the plurality of column hollow sections.

According to yet another embodiment, there is provided the assembly as defined above, wherein each one of the vertically spaced apart flooring structures comprises:

primary beam sections, wherein each one of the primary beam sections defines a beam first end and a beam second end, the beam first end being adapted to releasably and slidably engage with one of the spaced apart columns, the beam second end being adapted to releasably and slidably engage with an adjacent one of the spaced apart columns; and sliding members adapted to be releasably connected to the beam first end and the beam second end of each one of the primary beam sections, wherein each one of the sliding members is further adapted to releasably and slidably engage with the spaced apart columns.

According to another embodiment, there is provided the assembly as defined above, wherein each one of the sliding members comprises:

a sliding member main body; and a longitudinal sliding surface extending from the sliding member main body and adapted to releasably and slidably engage with the spaced apart longitudinal grooves.

According to a further embodiment, there is provided the assembly as defined above, wherein the sliding member main body defines a sliding member first end and a sliding member second end and further comprises:

a first spring loaded pin about the sliding member first end; and a second spring loaded pin about the sliding member second end;

the first and second spring loaded pins being adapted to engage with two of the spaced apart openings of one of the plurality of column hollow sections, wherein when the first and second spring loaded pins are disengaged from the one of the plurality of column hollow sections, the beam first end or the beam second end of one of the primary beam sections is capable of vertical displacement when supported by the spaced apart columns.

According to yet another embodiment, there is provided the assembly as defined above, wherein:

each one of the sliding members comprises spaced apart sliding member apertures formed within the sliding member main body; and each one of the primary beam sections comprises corresponding spaced apart beam apertures at its beam first and second ends; the assembly further comprising:

additional pin-like members for releasably connecting one of the sliding members with the first or the second beam end by providing one of the additional pin-like members to be introduced in one of the spaced apart sliding member aperture that is aligned with one of the corresponding spaced apart beam apertures.

According to another embodiment, there is provided the assembly as defined above, wherein each one of the vertically spaced apart flooring structures further comprises secondary beam sections to be releasably connected to at least some of the primary beam sections for securing the primary beam sections together.

According to a further embodiment, there is provided the assembly as defined above, wherein each one of the vertically spaced apart flooring structures further comprises primary spaced apart floor supporting elongated members to be releasably connected to the primary beam sections.

According to yet another embodiment, there is provided the assembly as defined above, wherein each one of the vertically spaced apart flooring structures further comprises flooring elements to be connected to the primary supporting elongated members.

According to another embodiment, there is provided the assembly as defined above, wherein each one of the protection structures comprises:

a plurality of horizontally oriented members and a plurality of vertically oriented members forming together a main frame defining a plurality of spaced apart access openings; and a meshed structure mounted on the main frame.

According to a further embodiment, there is provided the assembly as defined above, further comprising a protection enclosure configured to be releasably and slidably supported by the spaced apart columns, the protection enclosure being configured to be capable of vertical displacement when supported by the spaced apart columns.

According to yet another embodiment, there is provided the assembly as defined above, wherein the protection enclosure comprises:

a protection enclosure main frame defining a plurality of access openings and configured to releasably and slidably engage with the spaced apart longitudinal grooves;

a roofing structure extending from the enclosure main frame; and lifting assemblies to be operatively coupled to the protection enclosure main frame and further to the spaced apart columns;

wherein when the protection enclosure main frame is supported by the spaced apart columns, the protection enclosure main frame is capable of vertical displacement between a protection enclosure lower position and a protection enclosure upper position when the lifting assemblies are extended from a compressed position to an extended position.

According to another embodiment, there is provided the assembly as defined above, wherein each one of the lifting assemblies comprises:

an elongated jack defining a first jack end and a second jack end;

an upper slider adapted to be releasably connected to the first jack end and the protection enclosure main frame and further adapted to releasably and slidably engage with the spaced apart longitudinal grooves; and a lower slider adapted to be releasably connected to the second jack end and further adapted to releasably and slidably engage with the spaced apart longitudinal grooves at a distance from the upper slider.

BRIEF DESCRIPTION OF THE DRAWINGS

Further features and advantages of the present disclosure will become apparent from the following detailed description, taken in combination with the appended drawings, in which.

DETAILED DESCRIPTION

Figure 1:
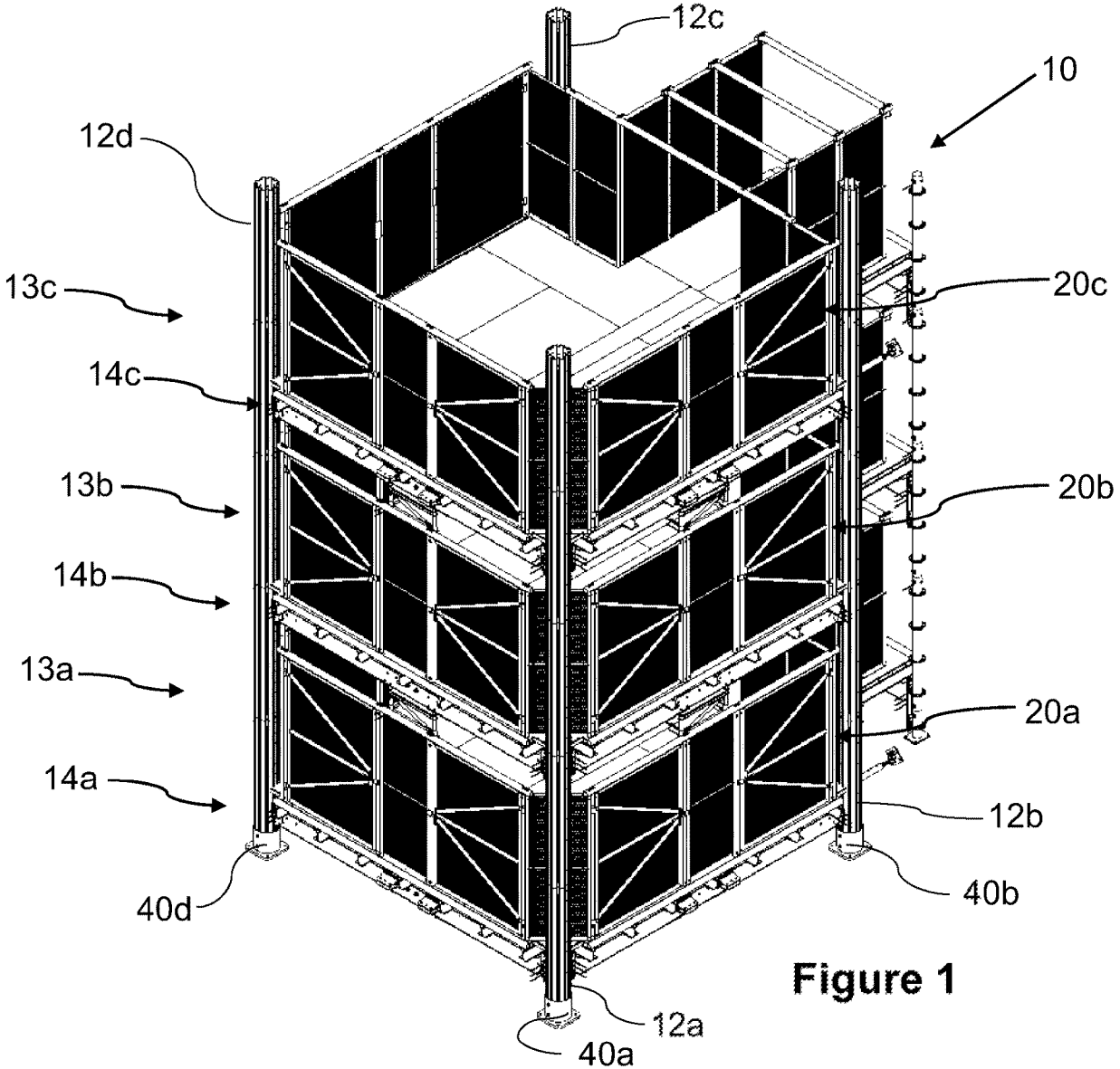
FIG. 1 is a top perspective view of a common tower in accordance with an embodiment, where three common tower floors are illustrated.
Figure 2:
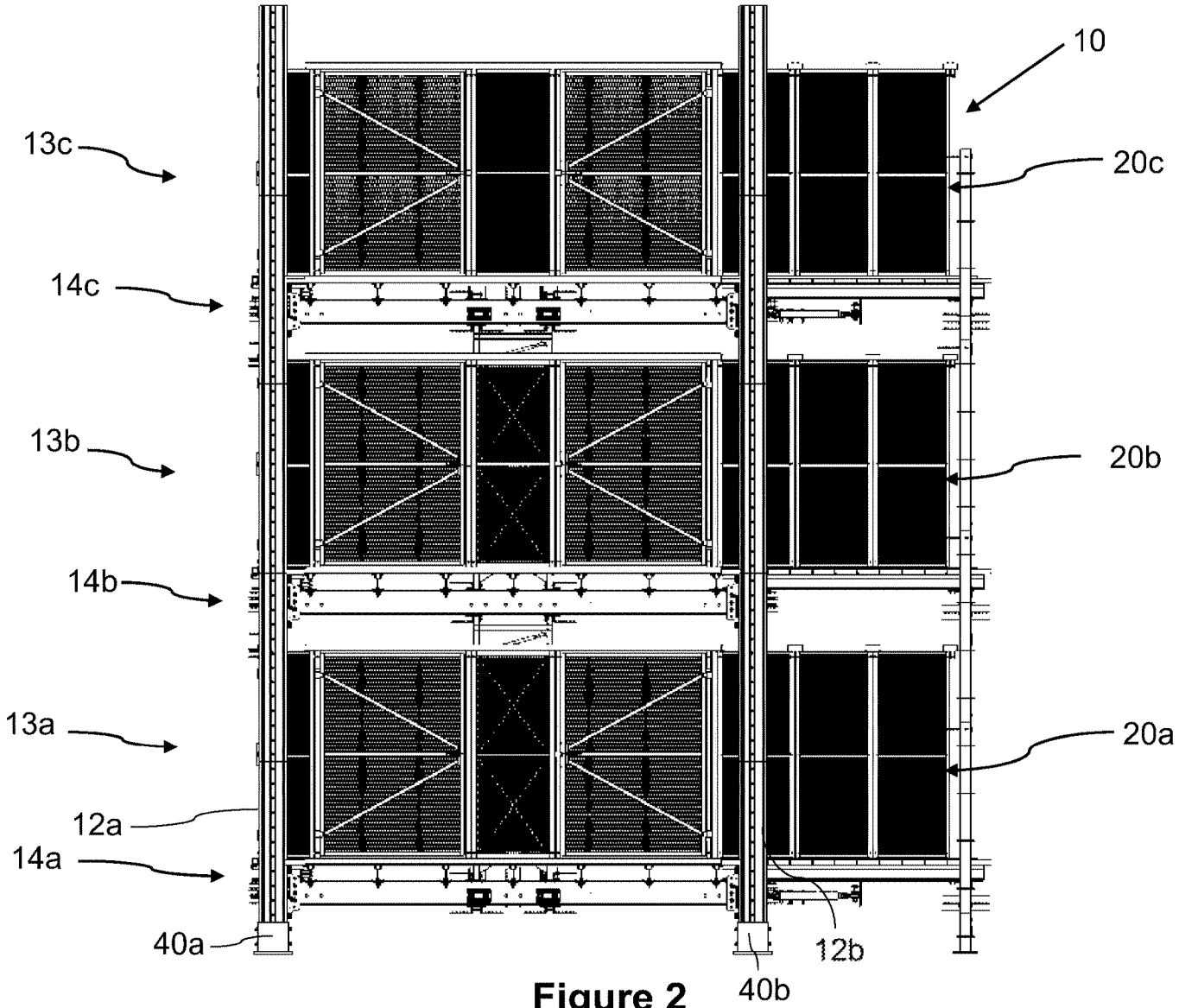
FIG. 2 is a side elevation view of the common tower shown in FIG. 1.

Referring now to the drawings and more particularly to FIGS. 1 and 2, there is shown an assembled/erected common tower 10, or tower 10, which is configured to be mounted/positioned adjacent a high-rise building structure in construction (not shown), such as adjacent a new building construction or adjacent a renovation project. Up to six hoisting equipment, facilities and/or machines of all types may thus be tied to and grouped around tower 10 once assembled/erected.

Still referring to FIGS. 1 and 2, there is shown that tower 10 comprises four spaced apart columns 12*a*, 12*b*, 12*c*, 12*d* adapted to be spacedly and vertically positioned adjacent the building structure and a plurality of vertically spaced apart flooring structures 14*a*, 14*b*, 14*c* which are releasably and slidably supported by spaced apart columns 12*a*, 12*b*, 12*c*, 12*d*. Columns 12*a*, 12*b*, 12*c*, 12*d* together with flooring structures 14*a*, 14*b*, 14*c* define three common tower floors 13*a*, 13*b*, 13*c*. A person skilled in the art to which tower 10 pertains (provided for high-rise building constructions) would understand that even if only three flooring structures 14*a*, 14*b*, 14*c*, or common tower floors 13*a*, 13*b*, 13*c*, are shown in FIGS. 1 and 2, tower 10 may include two flooring structures or more (or two common tower floors or more), as long as it provides the needed number of flooring structures to fully support the hoisting equipment along the building structure, which itself includes a predetermined number of building levels. Generally, tower 10 will include a number of flooring structures (or a number of common tower floors) that corresponds to the number of levels associated with the high-rise building structure.

Figure 3:
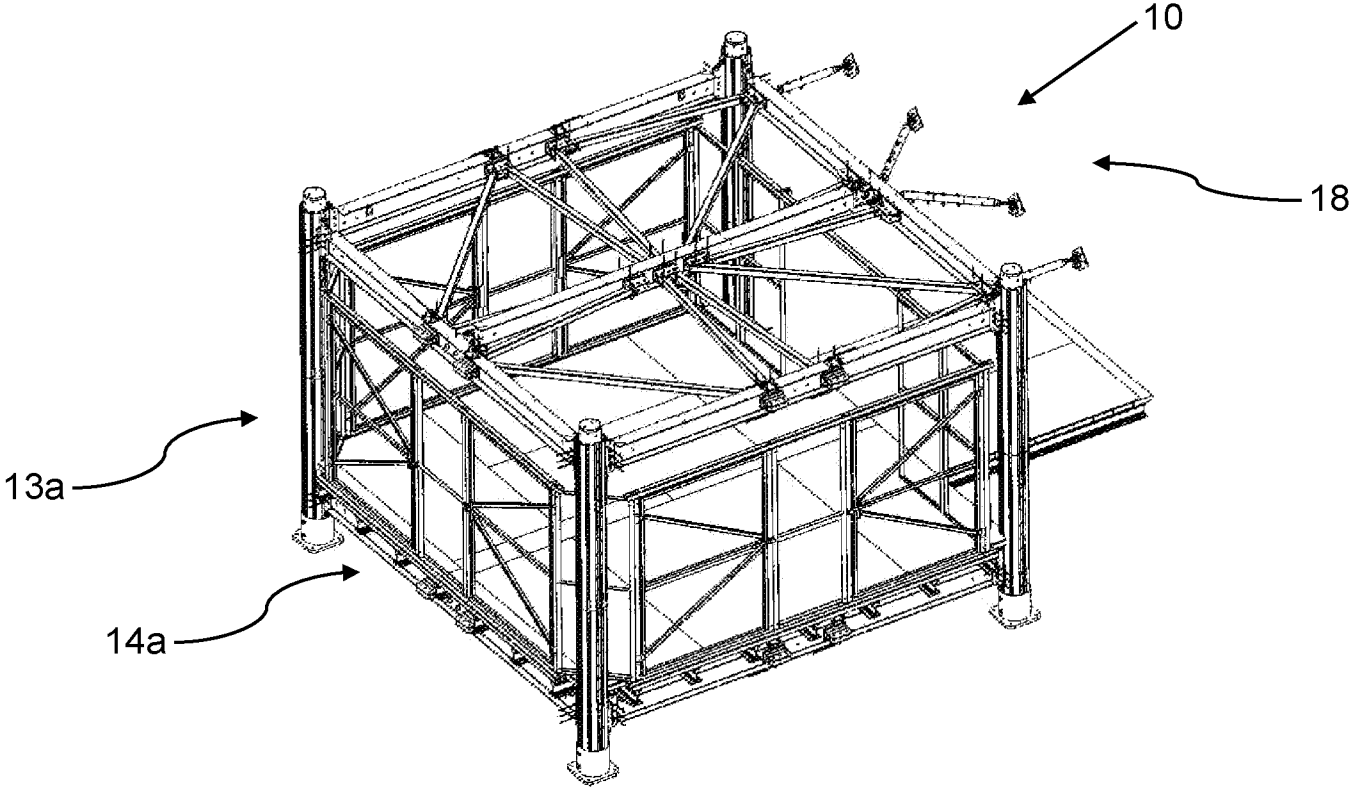
FIG. 3 is a perspective view of one common tower floor in accordance with another embodiment.

As better shown in FIG. 3, where only one flooring structure 14*a* and only one common tower floor 13*a* are illustrated, tower 10 further comprises an anchoring system 18 which is adapted to be fixed to (to securely engage) the building structure to maintain columns 12*a*, 12*b*, 12*c*, 12*d* as well as flooring structure 14*a* upright. Each common tower floor (one common tower floor shown in FIG. 3) may include its own anchoring system 18, but alternatively, only some of the common tower floors may include an anchoring system 18, as long as the plurality of anchoring systems 18 together provide sufficient strength to maintain tower 10 upright adjacent the building structure (usually provided where elevator's anchors are provided). Additionally, it is to be noted that a person skilled in the art to which tower 10 pertains would understand that even if four spaced apart columns 12*a*, 12*b*, 12*c*, 12*d* are illustrated in FIGS. 1 and 2, three or more columns may be used to assemble/erect such a common tower. According to these plurality of scenarios, less or more hoisting equipment may be tied to and grouped around the common tower. Moreover, such as to increase the number of hoisting equipment that may be tied to, and grouped close to, the building structure, more than one common tower 10 may be positioned adjacent one to the other. For example, a second tower 10 may be installed adjacent a first common tower 10 (where first common tower 10 is found to be adjacent building structure), using columns 12*a*, 12*d*. According to such a scenario, for one common tower floor, only six columns would support two horizontally aligned flooring structures, such as to provide ten individual accesses to the building structure. Such second tower 10 may also be provided to support a stairwell or a staircase opening, for example.

Still referring to FIGS. 1 and 2, there is shown that tower 10 further comprises protection structures 20*a*, 20*b*, 20*c* which are releasably mounted on each flooring structure 14*a*, 14*b*, 14*c* and/or columns 12*a*, 12*b*, 12*c*, 12*d* so as to upwardly extend from the flooring structures. Each protection structure is adapted to surround a main deck, and alternatively a secondary deck, being part of the flooring structure, as it will be described in more details below. Protection needs may vary from one common tower to another, such as to accommodate different hoisting needs. As it will be described in more details below, tower 10 further comprises a plurality of connectors releasably connecting the multiple components together, namely, columns 12*a*, 12*b*, 12*c*, 12*d*, flooring structures 14*a*, 14*b*, 14*c*, anchoring system 18, and protection structures 20*a*, 20*b*, 20*c*. Moreover, as it will be shown, many of the connectors provided to assemble/erect and disassemble/dismantle tower 10 are secured to columns 12*a*, 12*b*, 12*c*, flooring structures 14*a*, 14*b*, 14*c*, anchoring system 18, and/or protection structures 20*a*, 20*b*, 20*c*, providing a safer use of tower 10, during and after its erection.

Figure 4B:
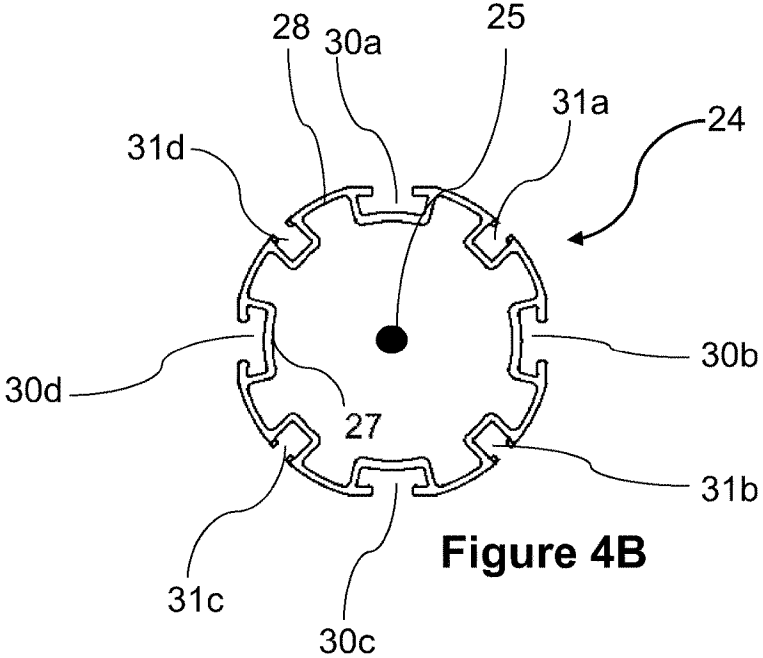
FIG. 4B is a top plan view of the column hollow section shown in FIG. 4A.
Figure 4A:
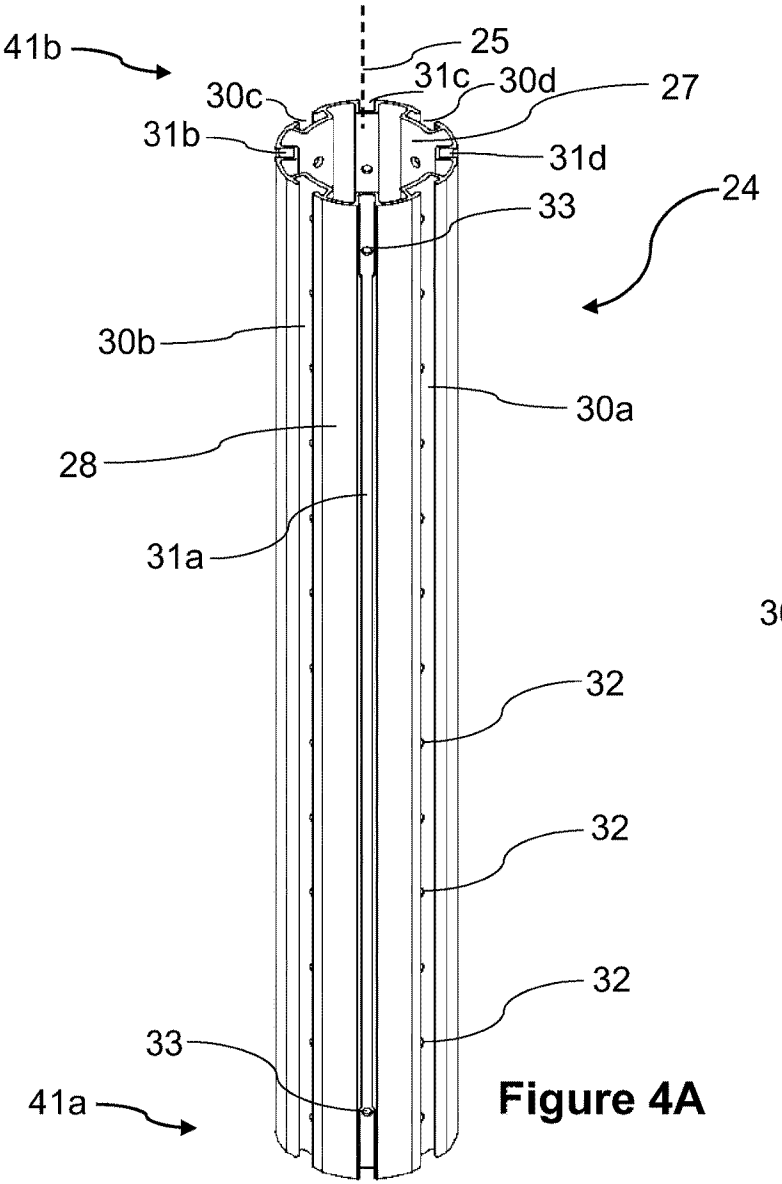
FIG. 4A is a perspective view of a column hollow section in accordance with a further embodiment.
Figure 4E:
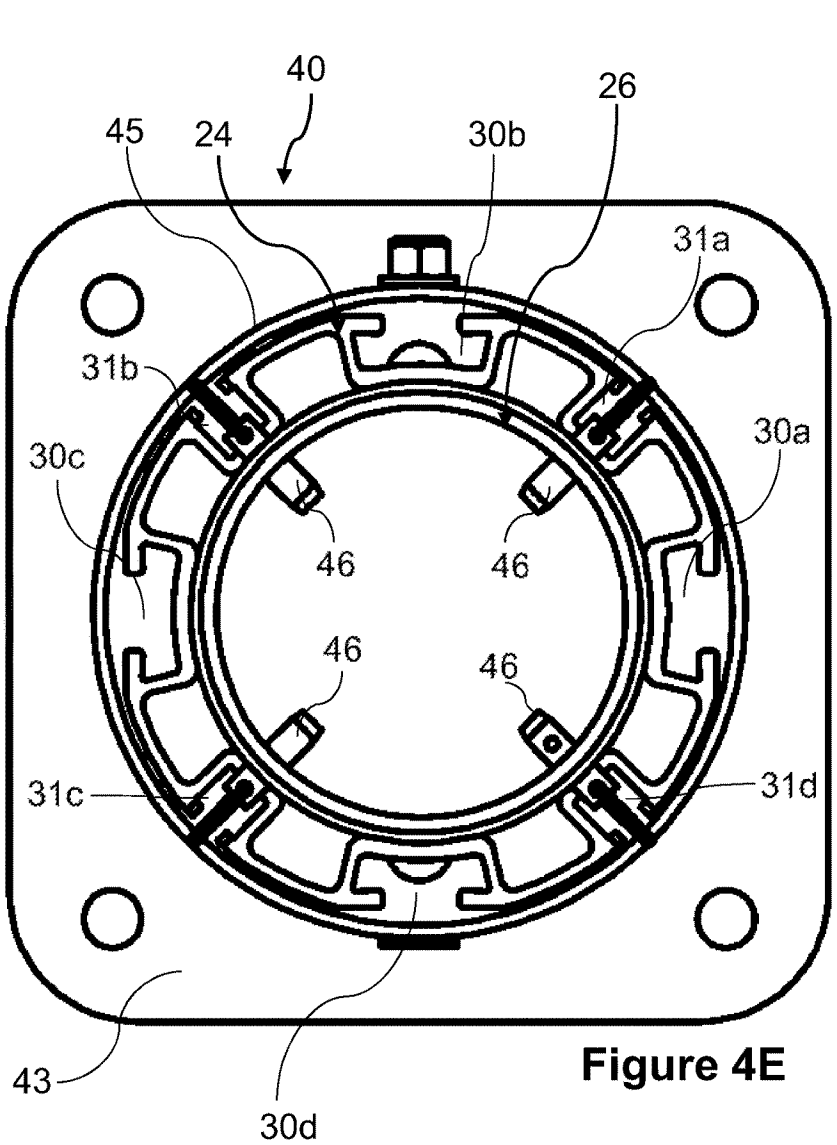
FIG. 4E is a top plan view of the column hollow section shown in FIG. 4C, that is releasably connected to the column base member.
Figure 4D:
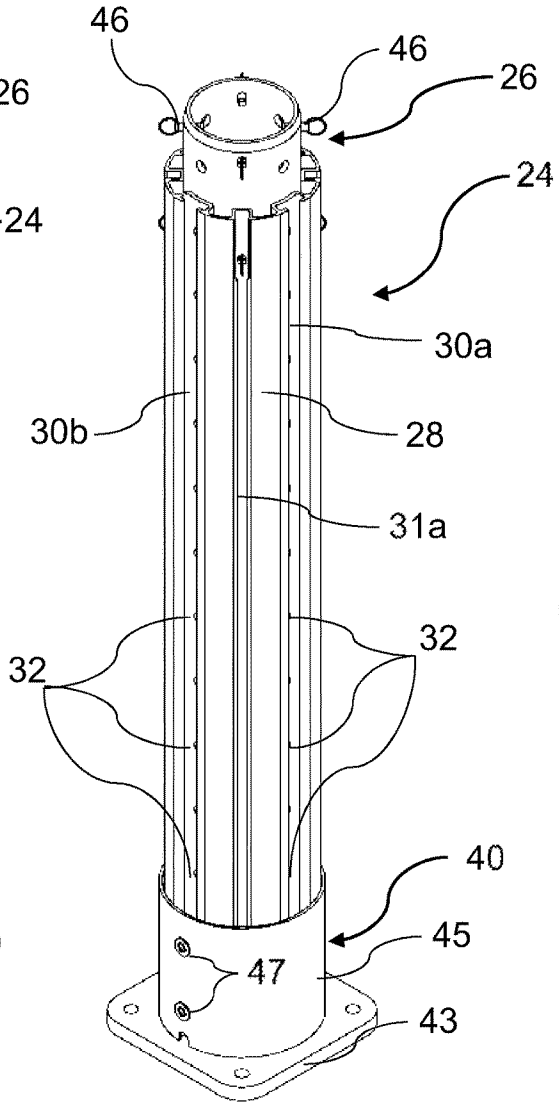
FIG. 4D is a top perspective view of the column hollow section shown in FIG. 4C, that is releasably connected to the column base member.
Figure 4C:
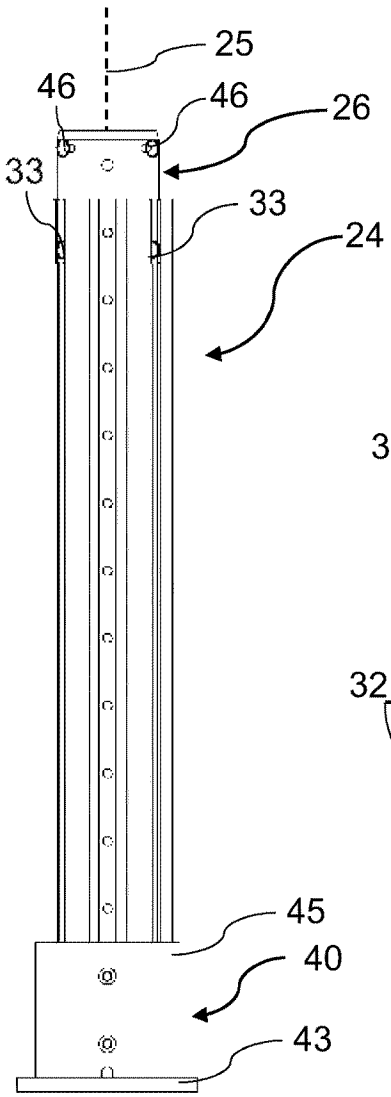
FIG. 4C is an elevation view of the column hollow section shown in FIG. 4A, that is releasably connected to a column base member.
Figure 4H:
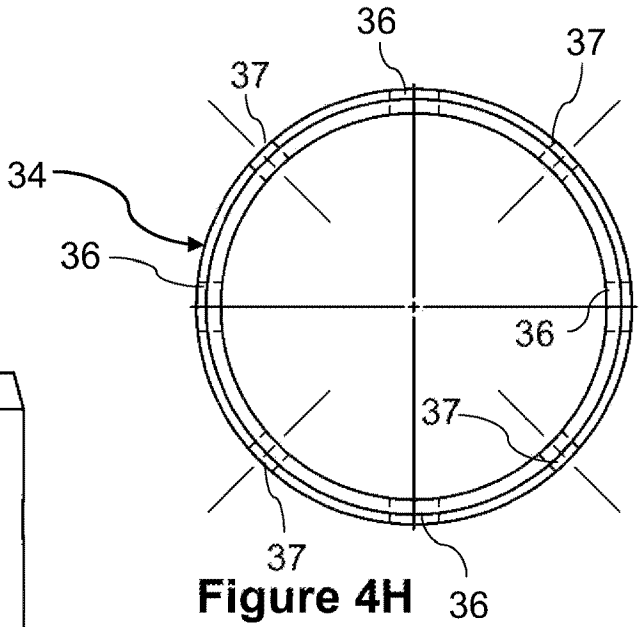
FIG. 4H is a top plan view of the column section-to-section connecting member shown in FIG. 4F.
Figure 4G:
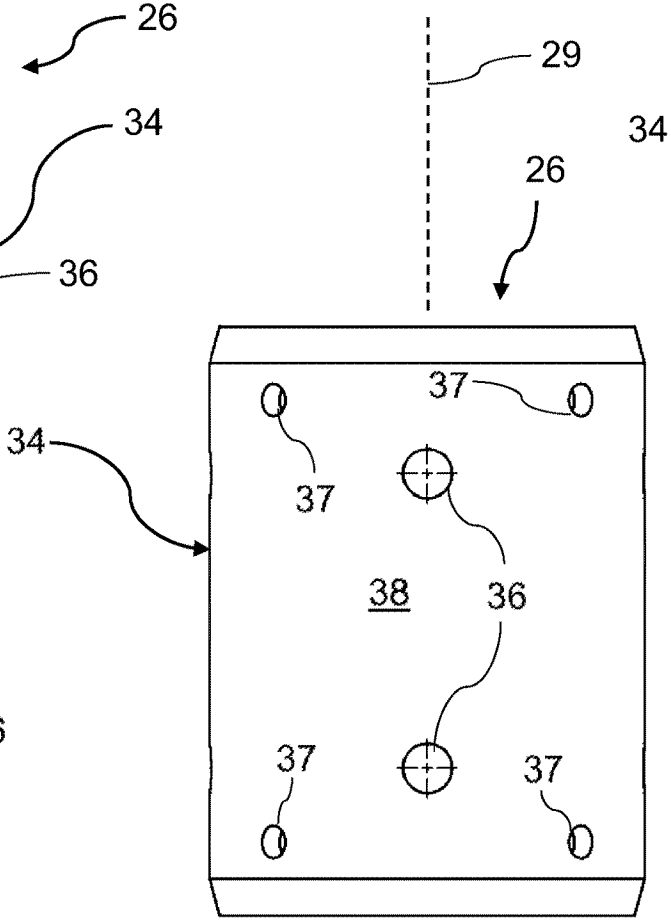
FIG. 4G is an elevation view of the column section-to-section connecting member shown in FIG. 4F.
Figure 4F:
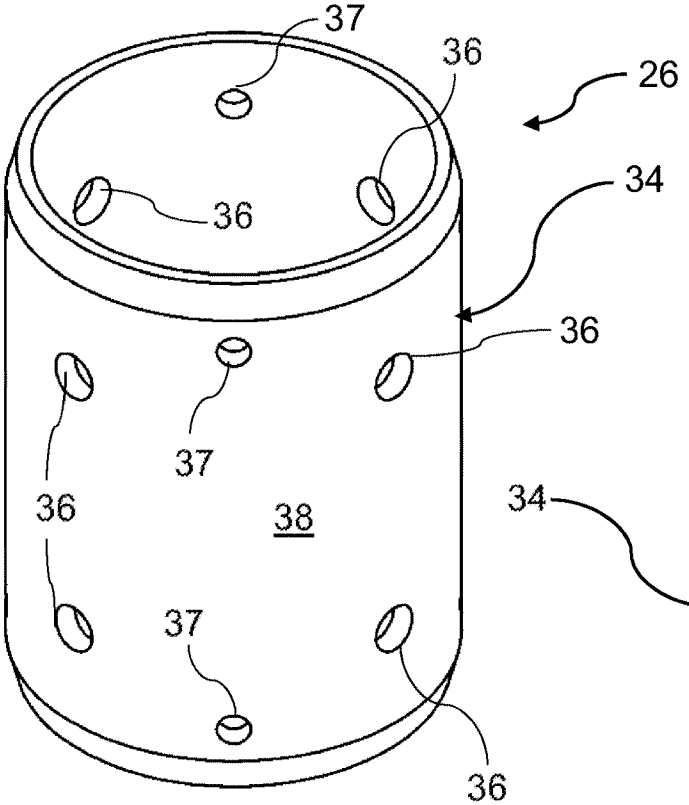
FIG. 4F is a perspective view of the column section-to-section connecting member shown in FIGS. 4C-4E, which is adapted to releasably connect adjacent column hollow sections together.
Figure 4J:
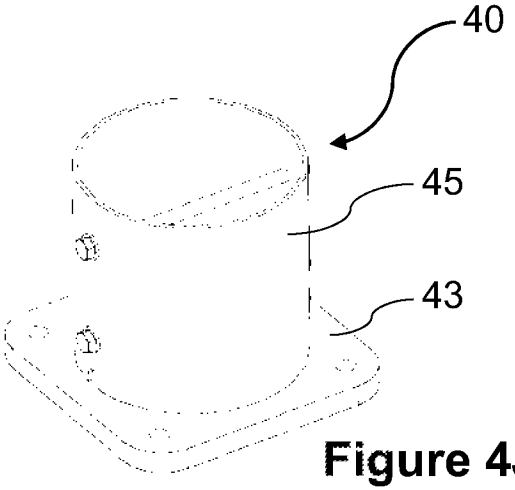
FIG. 4J is a perspective view of the column base member shown in FIGS. 4C-4E.
Figure 4I:
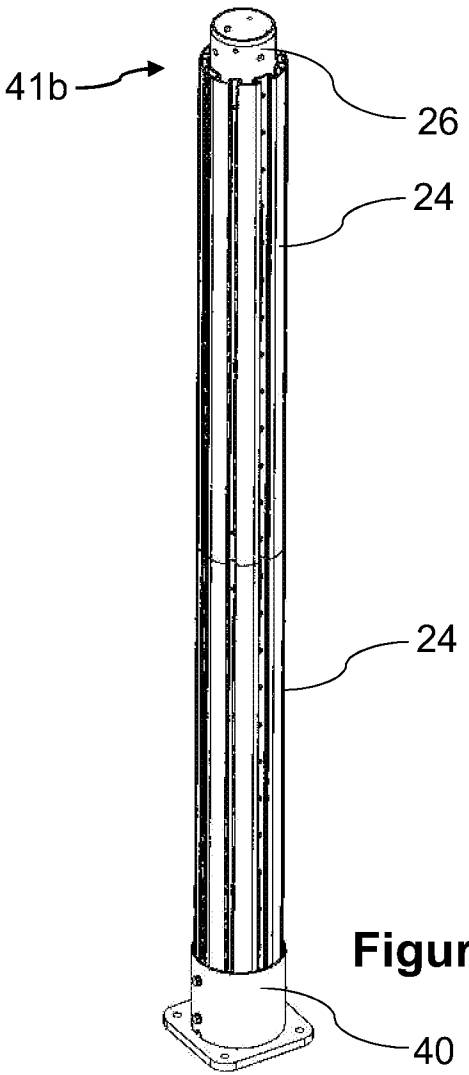
FIG. 4I is a perspective view of adjacent column hollow sections that are releasably connected one to another.
Figure 4L:
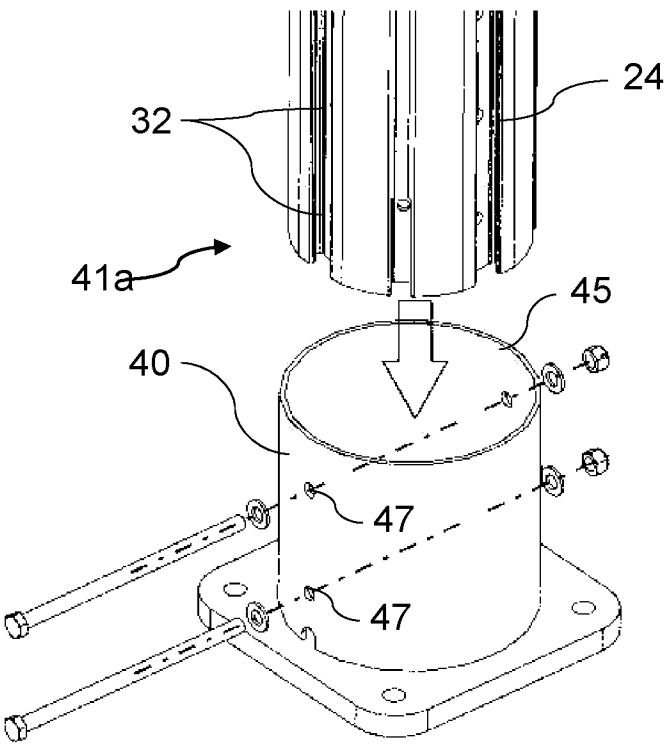
FIG. 4L is a perspective view of a column hollow section that is to be releasably connected with the column base member.
Figure 4K:
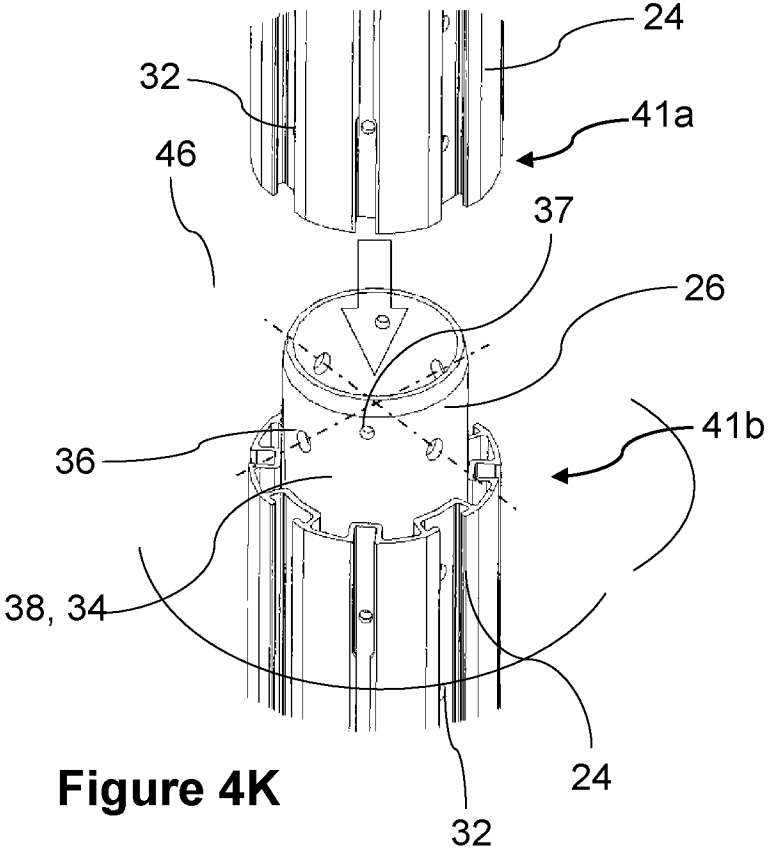
FIG. 4K is a perspective view of adjacent column hollow sections that are to be releasably connected together using the column section-to-section connecting member along with a plurality of pin-like members.

Referring now more particularly to FIGS. 4A to 4L, there is shown that each column 12*a*, 12*b*, 12*c*, 12*d* is made from a plurality of longitudinally aligned column hollow sections 24 (lower column hollow section 24 and upper column hollow section 24 shown in FIGS. 4I, 4K).

As well illustrated in FIGS. 4A, 4B, each column hollow section 24 defines a column section axis 25. Each column hollow section 24 is further configured to be releasably connected/assembled to an adjacent column hollow section 24. Indeed, each column 12*a*, 12*b*, 12*c*, 12*d* further comprises a plurality of column section-to-section connecting members (FIGS. 4F, 4G, 4H). Each column section-to-section connecting member 26 is adapted to releasably engage with two adjacent column hollow sections (FIG. 4K).

As well illustrated in FIGS. 4A-4E, each column hollow section 24 defines an inner surface 27, an outer surface 28 and four spaced apart longitudinal grooves 30*a*, 30*b*, 30*c*, 30*d* (the primary longitudinal grooves) radially aligned and formed within outer surface 28 (along overall length of column hollow section 24). Each column hollow section 24 further defines four spaced apart longitudinal grooves 31*a*, 31*b*, 31*c*, 31*d* (the secondary longitudinal grooves), formed inbetween longitudinal grooves 30*a*, 30*b*, 30*c*, 30*d*. As better shown in FIGS. 4A, 4C, 4D, spaced apart openings 32 are longitudinally aligned within longitudinal grooves 30*a*, 30*b*, 30*c*, 30*d*. Openings 33 are further formed/provided within longitudinal grooves 31*a*, 31*b*, 31*c*, 31*d*.

Referring now more particularly to FIGS. 4F, 4G, 4H, there is shown that column section-to-section connecting member 26 comprises a hollow main body 34, a first set of apertures 36 and a second set of apertures 37 formed therethrough. Each column section-to-section connecting member 26 defines a connecting member axis 29 (FIG. 4G). As shown in FIG. 4I, two adjacent column hollow sections 24 are releasably secured together via a first/lower column section-to-section connecting member (not shown), and a third column hollow section (not shown) may be releasably secured to hollow main body 34 of second/upper column section-to-section connecting member 26. For example, for each column 12*a*, 12*b*, 12*c*, 12*d*, two column hollow sections 24 may be longitudinally aligned and releasably secured together for each one of the common tower floors, as one column hollow section may have a length, for example, of about 6 feet. More or less column hollow section(s) may however be used to assemble/erect one common tower floor. Still referring to FIGS. 4F-4H, there is shown that hollow main body 34 defines a main body outer surface 38 adapted to interface with inner surface 27 of column hollow sections.

Referring now to FIG. 4A, there is shown that each one of the plurality of column hollow sections 24 together forming the spaced apart columns 12*a*, 12*b*, 12*c*, 12*d*, defines a first end/edge (or lower end/edge) 41*a* and a second end/edge (or upper end/edge) 41*b*. Therefore, each column 12*a*, 12*b*, 12*c*, 12*d* may be supported by a column base member 40*a*, 40*b*, 40*c*, 40*d* (FIGS. 1 and 2), the column base member 40 (FIGS. 4C, 4D, 4E, 4J, 4L) that is adapted to receive first or second ends 41*a*, 41*b* of column hollow sections 24 (as each column hollow section is symmetric). Indeed, it is important to be mentioned that column hollow sections 24 forming columns 12*a*, 12*b*, 12*c*, 12*d* are identical and symmetric, so they are all configured to interface/interconnect with column base members 40*a*, 40*b*, 40*c*, 40*d* (which are also identical/symmetric). As shown more particularly in FIGS. 4C-4E, 4J, 4L, each column base member 40 includes a plate member 43 and a hollow base structure 45 which upwardly extends from plate member 43 when column base member 40 is positioned on the surface adjacent the building structure, with two sets of vertically aligned apertures 47 formed therethrough.

Therefore, when assembling a column hollow section 24 with a column base member 40, column base member 40 is positioned on a surface adjacent the building structure. First section end 41*a* of column hollow section 24 is introduced within hollow base structure 45 of column base member 40 and releasably secured introducing bolts within first and second sets of apertures 47 formed within hollow base structure 45 and further within the lower ones of the spaced apart openings 32 found in longitudinal grooves 30*a*, 30*b*, 30*c*, 30*d* (FIG. 4L). A person skilled in the art to which common tower 10 pertains would however understand that other securing members and/or mechanisms may be used in a way to releasably secure a column hollow section end to a column base member 40 in a way to support each one of columns 12*a*, 12*b*, 12*c*, 12*d*.

Referring now more particularly to FIG. 4K, column section-to section connecting member 26 is then introduced within column hollow section 24 about at its second end 41*b* in a way that outer surface 38 defined by hollow main body 34 interfaces with inner surface 27 defined by column hollow section 24. First/lower end 41*a* of an adjacent/upper column hollow section 24 is then positioned over column section-to-section connecting member 26, until first/lower end 41*a* (or edge) of upper column hollow section 24 interfaces with second/upper end 41*b* (or edge) of lower column hollow section 24. Still referring to FIG. 4K, height pin-like members 46 are introduced in spaced apart openings 32 (formed within longitudinal grooves 30*a*, 30*b*, 30*c*, 30*d*) that are aligned with first set of apertures 36 (formed within hollow main body 34), such as to secure upper and lower column hollow sections 24 to (over) column section-to-section connecting member 26. It is important to be mentioned that pin-like members 46 are linked by chains, steel wires or any other connections, so that no connector may fall from tower 10 during/after its erection/assembly (or during steps of assembling column hollow sections together). An upper column section-to-section connecting member 26 (FIG. 4I) is introduced within upper column hollow section 24 about its second/upper end 41*b*, as defined above, and by aligning their respective column section axis 25 and connecting member axis 29. Therefore, when columns 12*a*, 12*b*, 12*c*, 12*d* are assembled and aligned together, column section-to-section connecting members 26 are concentric with longitudinally aligned column hollow sections 24 that are longitudinally aligned one over another (FIG. 4E). The remaining column hollow sections for each column 12*a*, 12*b*, 12*c*, 12*d* will be installed after one flooring structure, or alternatively two flooring structure(s), is/are releasably and slidably supported by the first two column hollow sections 24 of each column 12*a*, 12*b*, 12*c*, 12*d*. In other words, one common tower floor may be assembled/erected at a time. Additionally, it is to be mentioned that even if column base member 40 was described as firstly connected with first/lower column hollow section 24, it is further possible to releasably connect first/lower and second/upper column hollow sections 24 together first, and then to secure lower end 41*a* of one of the two column hollow sections 24 with column base member 40.

Figure 5B:
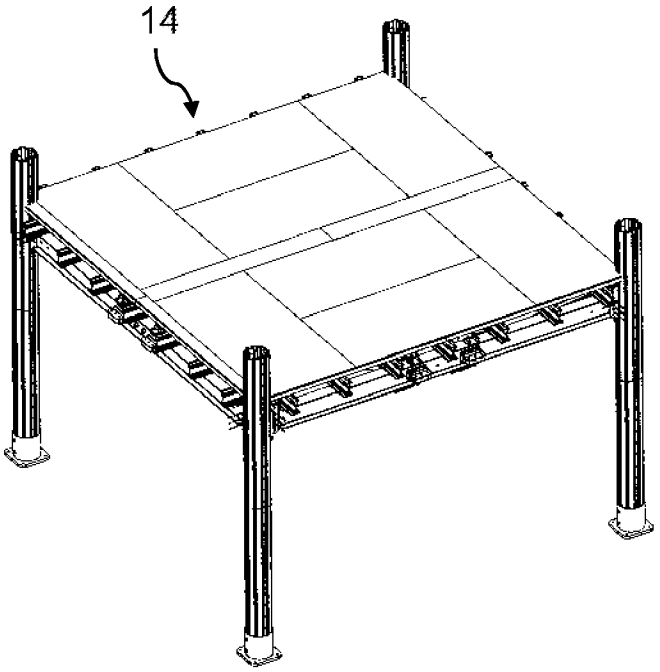
FIG. 5B is a perspective view of the flooring structure shown in FIG. 5A that is releasably and slidably connected to the spaced apart columns, where the flooring structure is illustrated in its uppermost position.
Figure 5A:
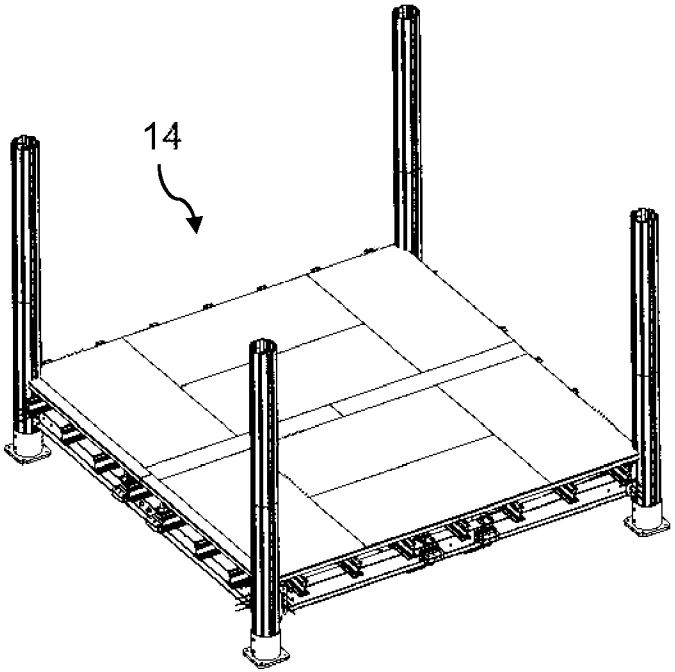
FIG. 5A is a perspective view of a flooring structure that is releasably and slidably connected to the spaced apart columns, where the flooring structure is illustrated in its lowermost position.

Referring now more particularly to FIGS. 5A and 5B, as mentioned above, tower 10 comprises a plurality of vertically spaced apart flooring structures (14*a*, 14*b*, 14*c* shown in FIGS. 1 and 2), referred to as 14 in FIGS. 5A and 5B. Indeed, FIGS. 5A and 5B illustrate flooring structure 14 that is releasably and slidably supported by and/or connected to spaced apart columns 12*a*, 12*b*, 12*c*, 12*d*. Flooring structure 14 shown in FIG. 5A is illustrated in its lowermost position, while flooring structure 14 shown in FIG. 5B is illustrated in its uppermost position.

Figure 6A:
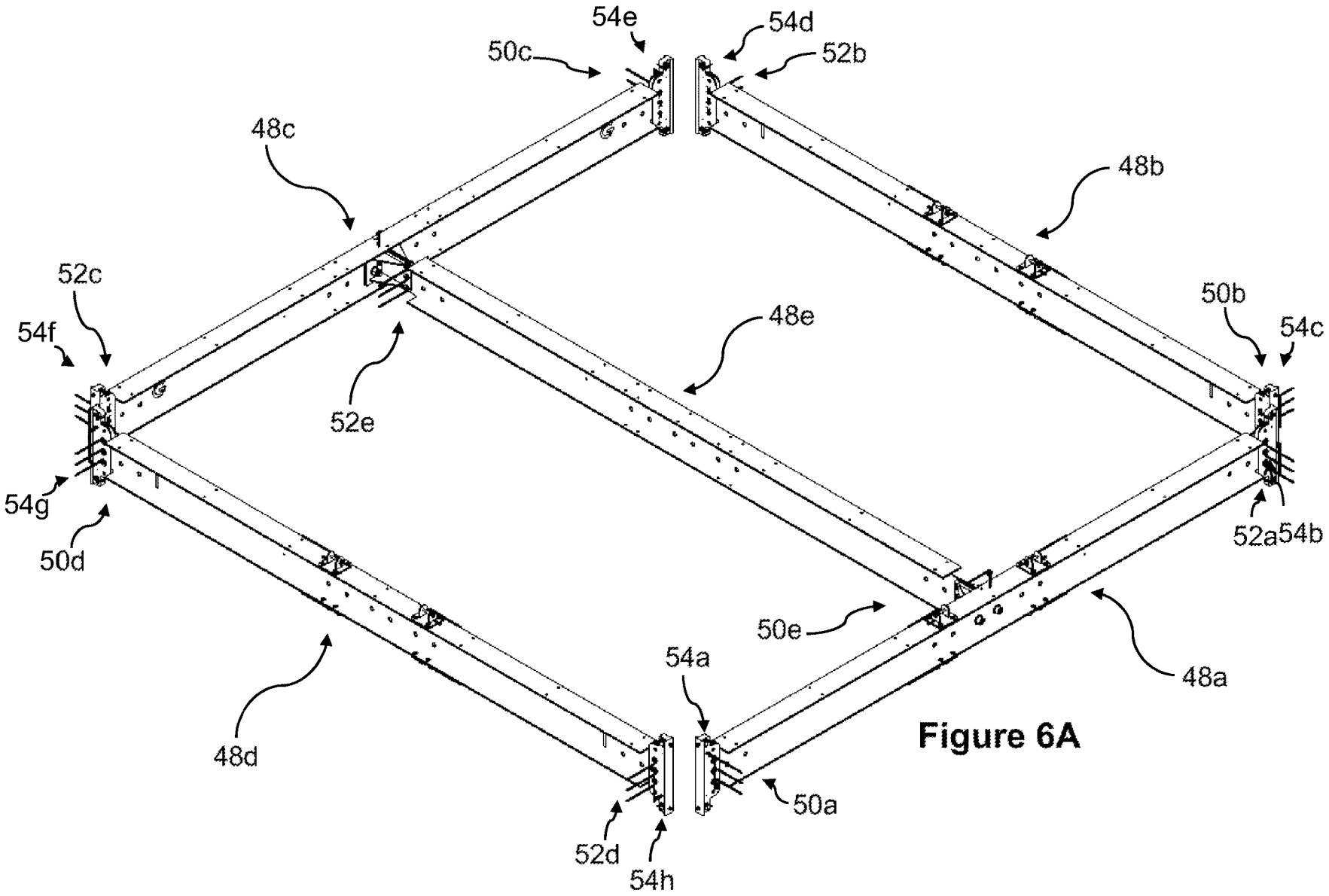
FIG. 6A is a perspective view of the primary beam sections (or primary landing beam sections) that together form a deck supporting structure.
Figure 6B:
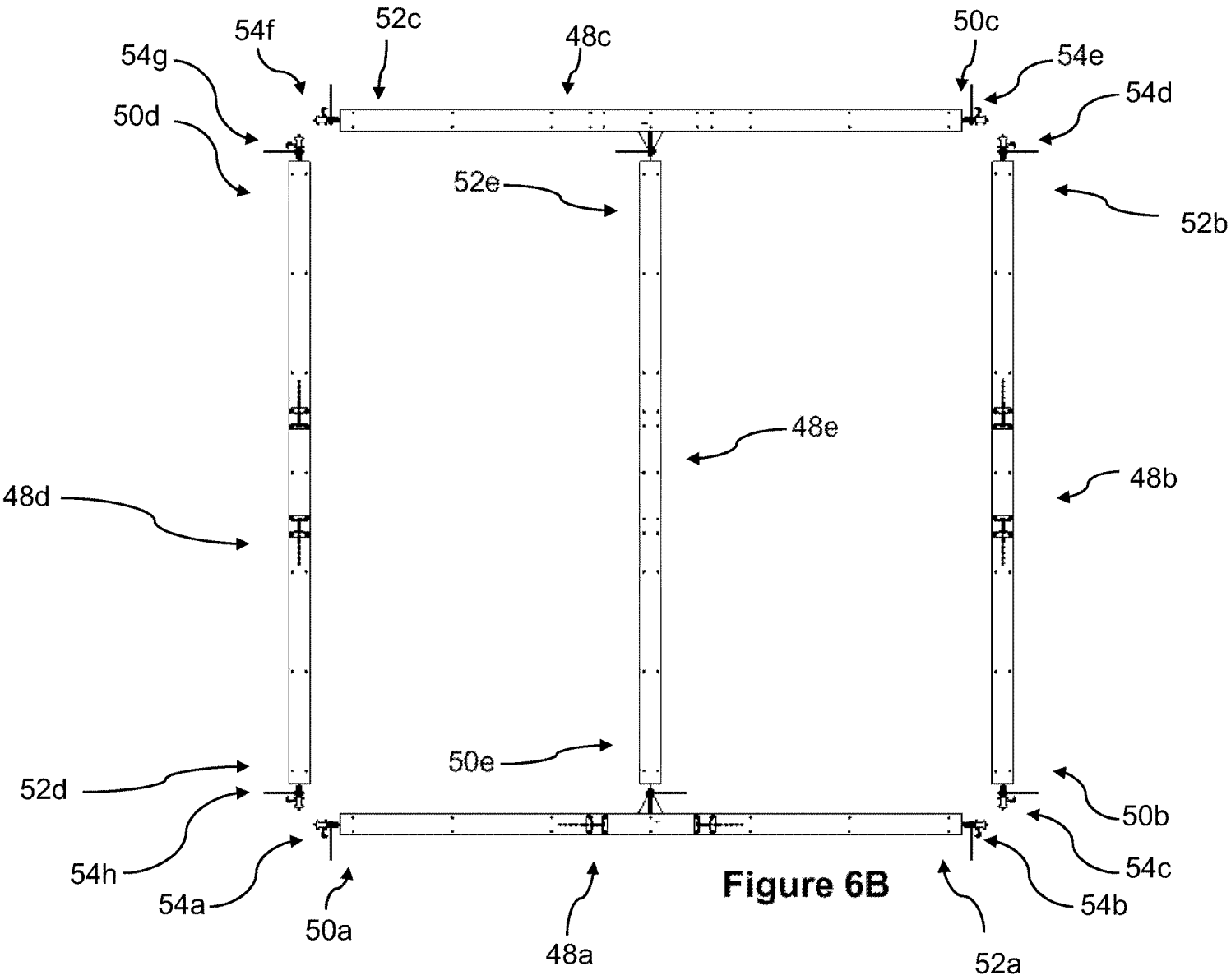
FIG. 6B is a top plan view of the primary beam sections shown in FIG. 6A.

Referring now more particularly to FIGS. 6A and 6B, there is shown that flooring structure 14 is made of four primary beam sections 48*a*, 48*b*, 48*c*, 48*d*, and a fifth primary beam section 48*e*, namely the primary landing beam sections, that will be, once slidably mounted on columns 12*a*, 12*b*, 12*c*, 12*d*, perpendicularly (48*a*, 48*b*, 48*c*, 48*d*) assembled one about another (in the scenario where four columns are provided). Each one of primary beam sections 48*a*, 48*b*, 48*c*, 48*d*, 48*e* defines a beam first end 50*a*, 50*b*, 50*c*, 50*d*, 50*e* and a beam second end 52*a*, 52*b*, 52*c*, 52*d*, 52*e*. Beam first ends 50*a*, 50*b*, 50*c*, 50*d* are adapted to releasably and slidably engage with a respective column 12*a*, 12*b*, 12*c*, 12*d*, while beam second ends 52*a*, 52*b*, 52*c*, 52*d* are adapted to releasably and slidably engage with an adjacent one of the spaced apart columns 12*a*, 12*b*, 12*c*, 12*d*. In other words, still referring to FIGS. 6A and 6B, ends 50*a*, 52*d* of primary beam sections 48*a*, 48*d* are adapted to releasably and slidably engage with column 12*a*, ends 52*a*, 50*b* of primary beam sections 48*a*, 48*b* are adapted to releasably and slidably engage with column 12*b*, ends 52*b*, 50*c* of primary beam sections 48*b*, 48*c* are adapted to releasably and slidably engage with column 12*c* and ends 52*c*, 50*d* of primary beam sections 48*c*, 48*d* are adapted to releasably and slidably engage with column 12*d*, thanks to sliding members 54*a*, 54*b*, 54*c*, 54*d*, 54*e*, 54*f*, 54*g*, 54*h* that will be described in more details below.

Now referring to FIGS. 8A-8E, there is shown that each primary beam section 48*a*, 48*b*, 48*c*, 48*d* is configured to be releasably and slidably connected to or supported by two adjacent columns 12*a*, 12*b*, 12*c*, 12*d* by releasably connecting a sliding member 54*a*, 54*b*, 54*c*, 54*d*, 54*e*, 54*f*, 54*g*, 54*h* to a beam first or second end 50*a*, 50*b*, 50*c*, 50*d*, 52*a*, 52*b*, 52*c*, 52*d* and by releasably and slidably connecting the sliding member to a column 12*a*, 12*b*, 12*c*, 12*d*. Indeed, each sliding member, referred to as sliding member 50 in FIGS. 8A-8E, comprises a sliding member main body 55 and a longitudinal sliding surface or elongated portion 56 extending from the sliding member main body 55. Longitudinal sliding surface or elongated portion 56 is configured to releasably and slidably engage with spaced apart longitudinal grooves 30*a*, 30*b*, 30*c*, 30*d*. A person skilled in the art to which tower 10 pertains would here understand that even if sliding surface or elongated portion 56 is shown to adopt a T-like shape, sliding surface or elongated portion 56 may adopt any cross-sectional size, shape and/or configuration, as long as it can be introduced in, and secured to, longitudinal grooves 30*a*, 30*b*, 30*c*, 30*d* of a column hollow section 24 in a downward or upward sliding movement relatively to columns 12*a*, 12*b*, 12*c*, 12*d*, such as to provide a strong connection between sliding member 54 and columns 12*a*, 12*b*, 12*c* or 12*d* when sliding member 54 is pulled away from its respective column (or alternatively pushed upward or downward within grooves 30*a*, 30*b*, 30*c*, 30*d*).

Still referring to FIGS. 8A-8E, sliding member main body 55 further defines a beam receiving groove 57 (opposite longitudinal sliding surface or portion 56), a sliding member first/upper end 58 and a sliding member second/lower end 60. Each sliding member 54 thus further comprises a first spring loaded pin 62 operatively mounted on sliding member main body 55 about sliding member upper end 58 and a second spring loaded pin 64 also operatively mounted on sliding member main body 55 about sliding member lower end 60. First and second spring loaded pins 62, 64 are adapted to engage with two of the spaced apart openings 32 formed within each one of the longitudinally aligned column hollow sections 24. Therefore, when first and second spring loaded pins 62, 64 are disengaged from longitudinally aligned column hollow sections 24 or columns 12*a*, 12*b*, 12*c*, 12*d*, primary beam sections 48*a*, 48*b*, 48*c*, 48*d* are capable of horizontal displacement relatively to spaced apart columns 12*a*, 12*b*, 12*c*, 12*d*. One may pull first or second spring loaded pin 62, 64 to disengage spring loaded pins 62, 64, or may turn it to lock in place. Height of each flooring structure relatively to the ground surface or to an adjacent flooring structure may thus be adjusted independently, so it is possible to make correspond the common tower floors with the building levels of the high-rise building into construction. Indeed, a penthouse, or a mechanical room, usually provided with high ceilings, for example, will require the distance between two adjacent common tower floors to be increased.

Figure 8B:
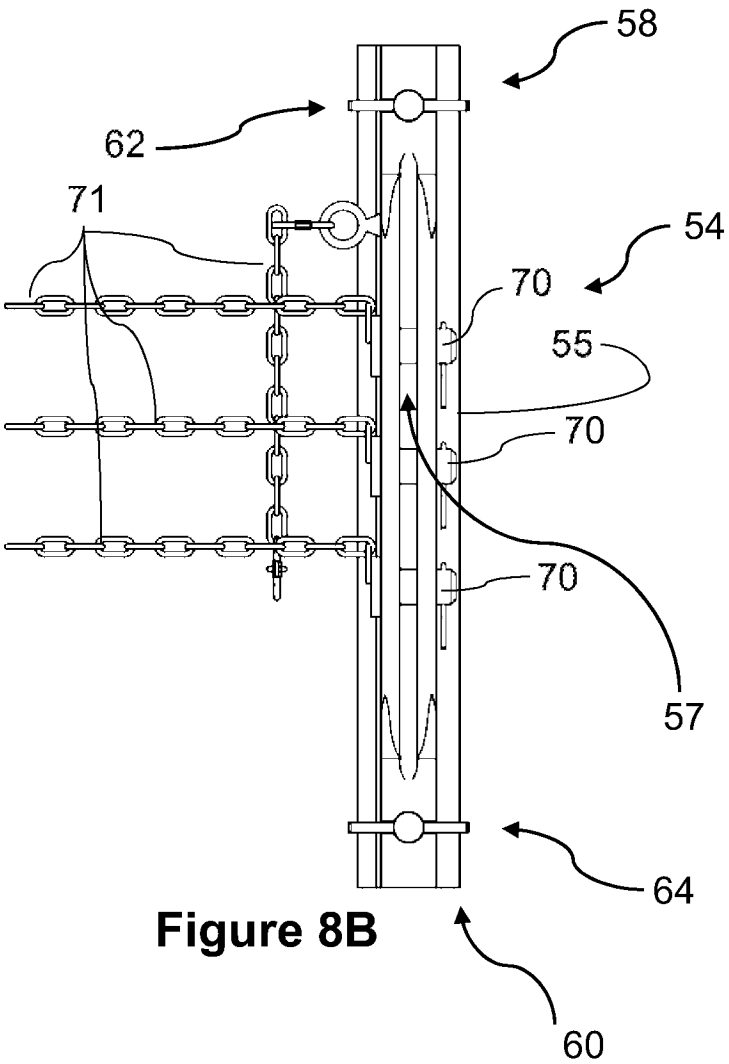
FIG. 8B is an elevation view (side to be connected to primary beam end) of the sliding member shown in FIG. 8A.
Figure 8A:
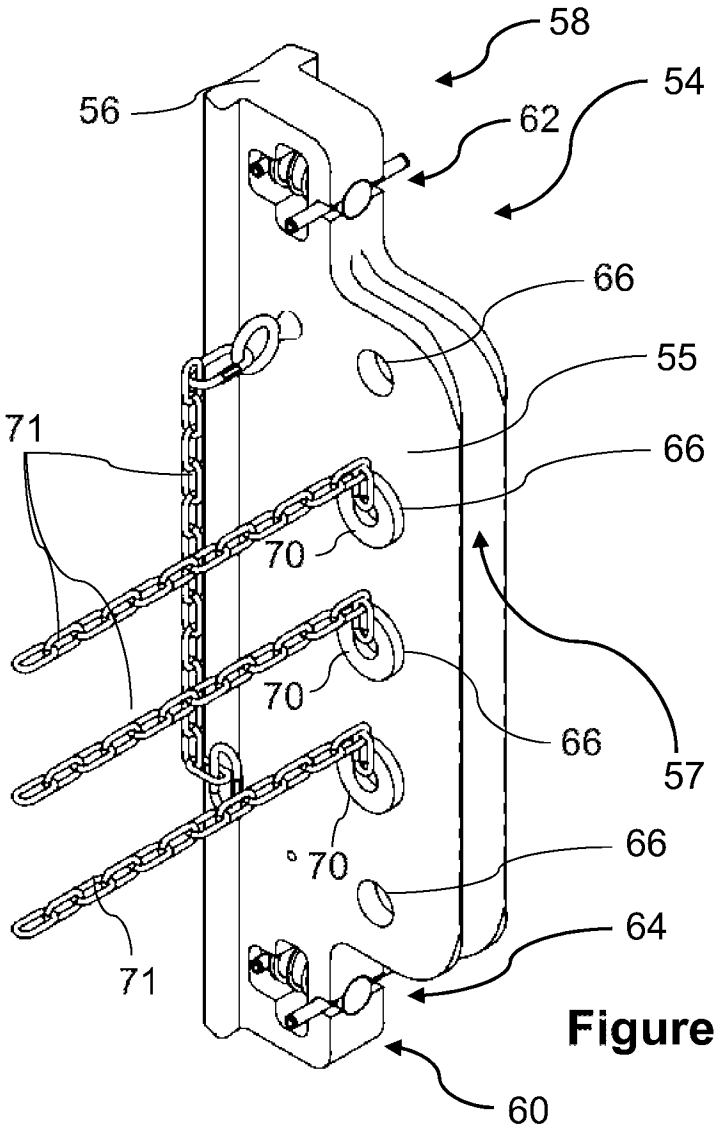
FIG. 8A is a perspective view of a sliding member in accordance with yet another embodiment.
Figure 8D:
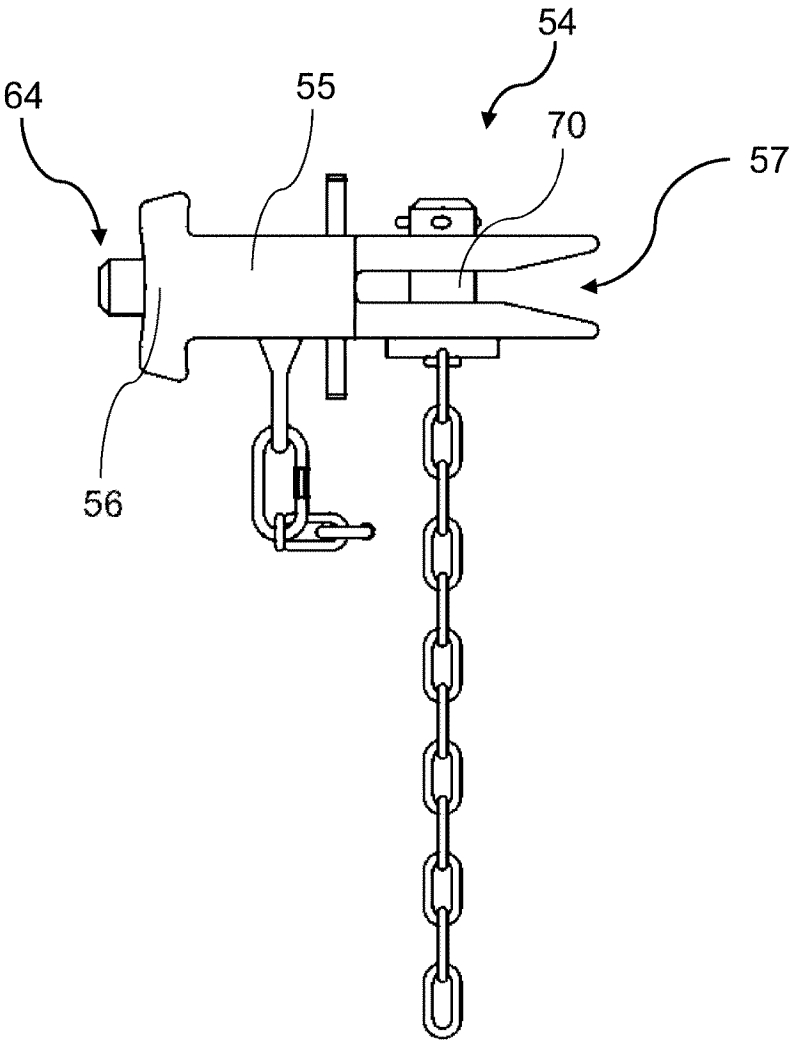
FIG. 8D is a top plan view of the sliding member shown in FIG. 8A.
Figure 8C:
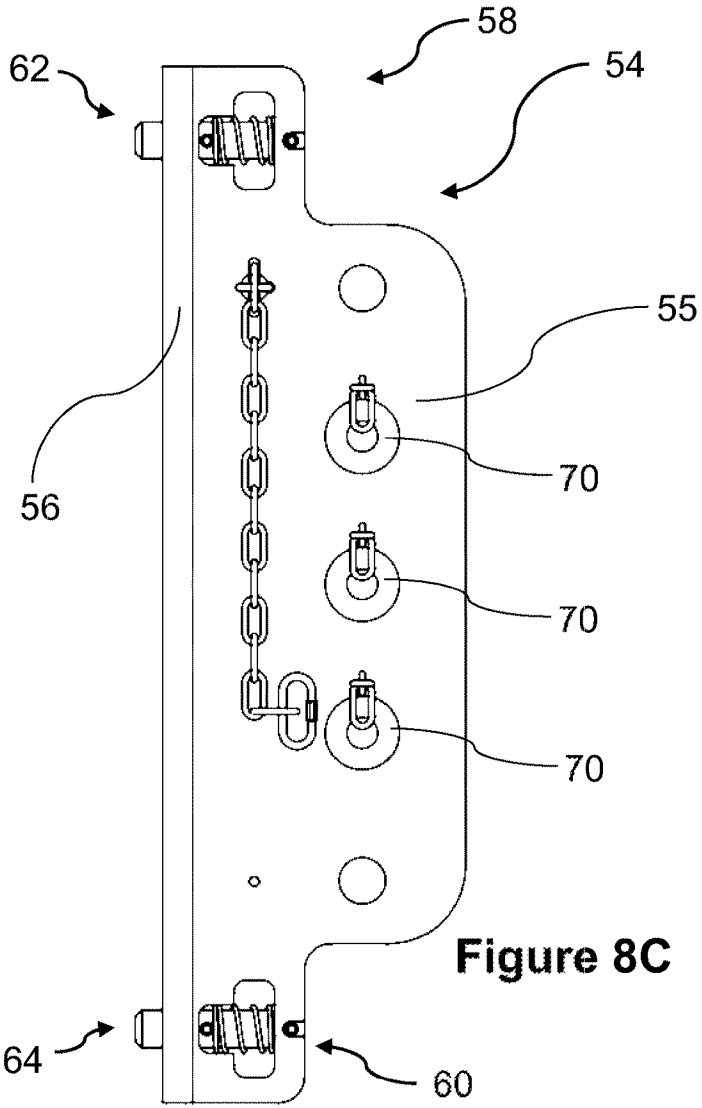
FIG. 8C is a side elevation view of the sliding member shown in FIG. 8A.
Figure 8E:
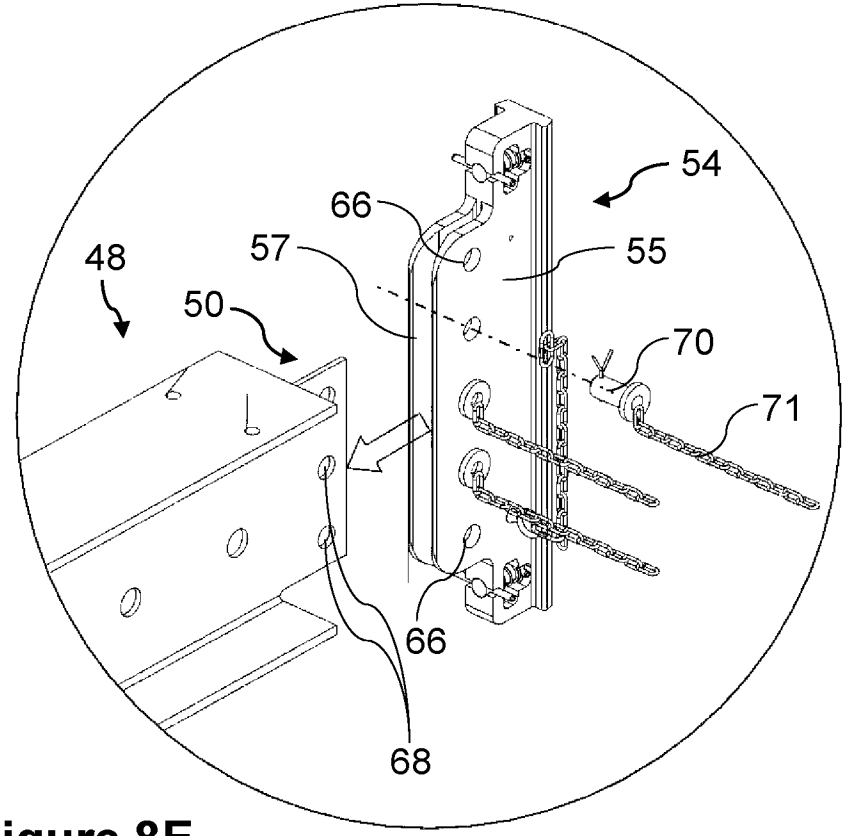
FIG. 8E is a perspective view of a sliding member that is to be releasably connected to a primary beam section and that is further adapted to be releasably and slidably connected to a column for installation of the flooring structure.

Still referring to FIGS. 8A-8E, each sliding member 54 further comprises spaced apart sliding member apertures 66 formed through beam receiving groove 57 of sliding member main body 55 (opposite longitudinal sliding surface or portion/connector 56), while primary beam sections 48*a*, 48*b*, 48*c*, 48*d* (illustrated as 48) each comprises corresponding spaced apart beam apertures 68 (FIG. 8E) at their beam first and second ends (50*a*, 50*b*, 50*c*, 50*d*, 52*a*, 52*b*, 52*c*, 52*d*), in FIG. 8E illustrated as 50. Therefore, additional pin-like members 70 are here used to releasably connect sliding member 54 with beam end 50 that is introduced within beam receiving groove 57. Pin-like members 70 are introduced within spaced apart sliding member apertures 66 and further within corresponding spaced apart beam apertures 68 that are aligned one with another, such as to provide a "beam-to-sliding member" assembly. It is further important to be mentioned that pin-like members 70 are fixed/secured to sliding member 54 using chains 71 or similar elements, and that first and second spring loaded pins 62, 64 are integrated into sliding member main body 55 so that security during installation is increased (no such connector can fall from tower 10 during or after its erection). It is further important to be mentioned that sliders 54 are symmetrically formed, so it can be oriented according to two different positions (spring loaded pin 62 above spring loaded pin 64, or below spring loaded pin 62, when installed on column/beam). Such symmetricity of the column hollow sections 26, but further of the sliding members 54, makes it easier to assemble components of tower 10 together.

Figure 7A:
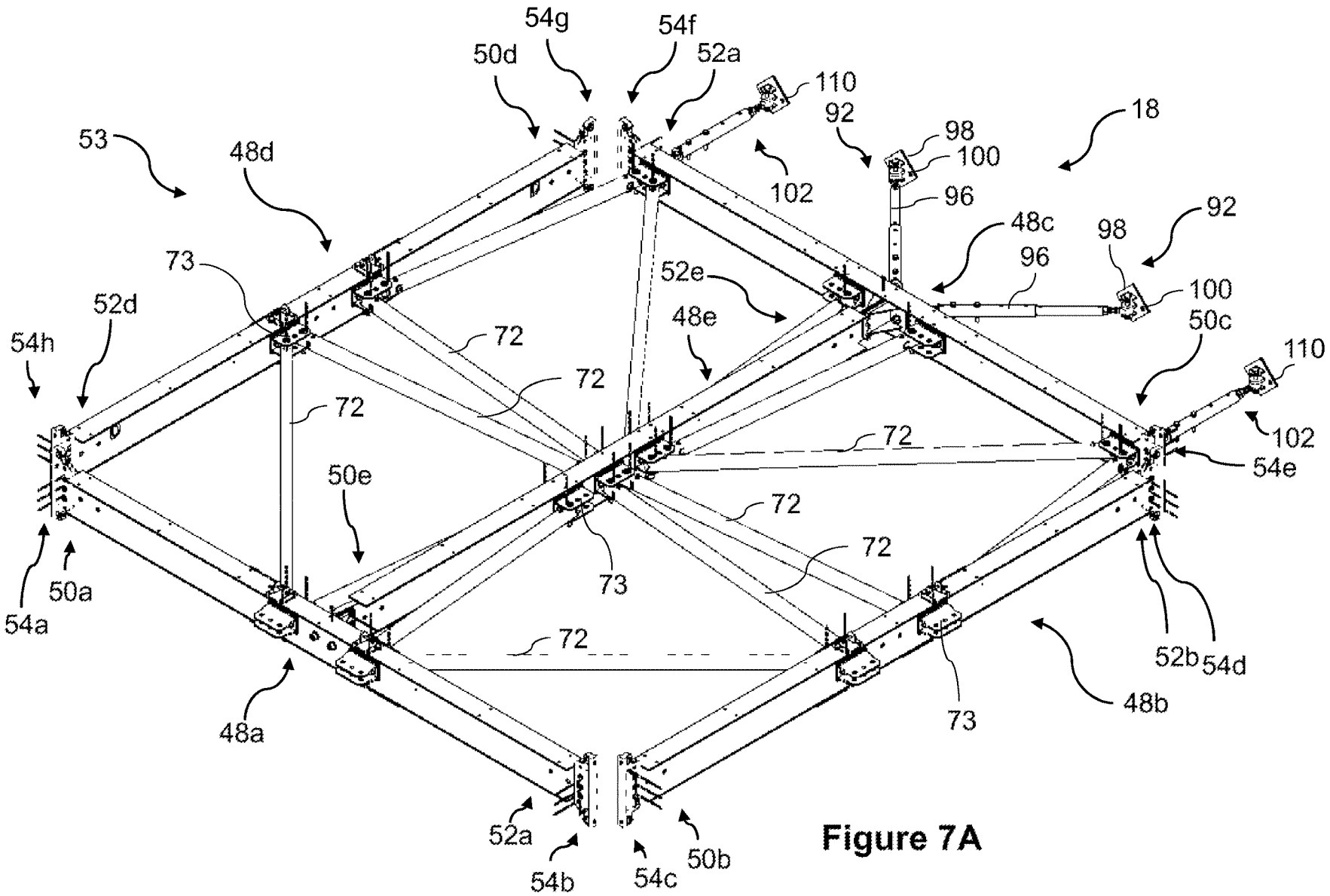
FIG. 7A is a perspective view of the primary beam sections and further of the secondary beam sections (or secondary landing beam sections) that together form the deck supporting structure.
Figure 7B:
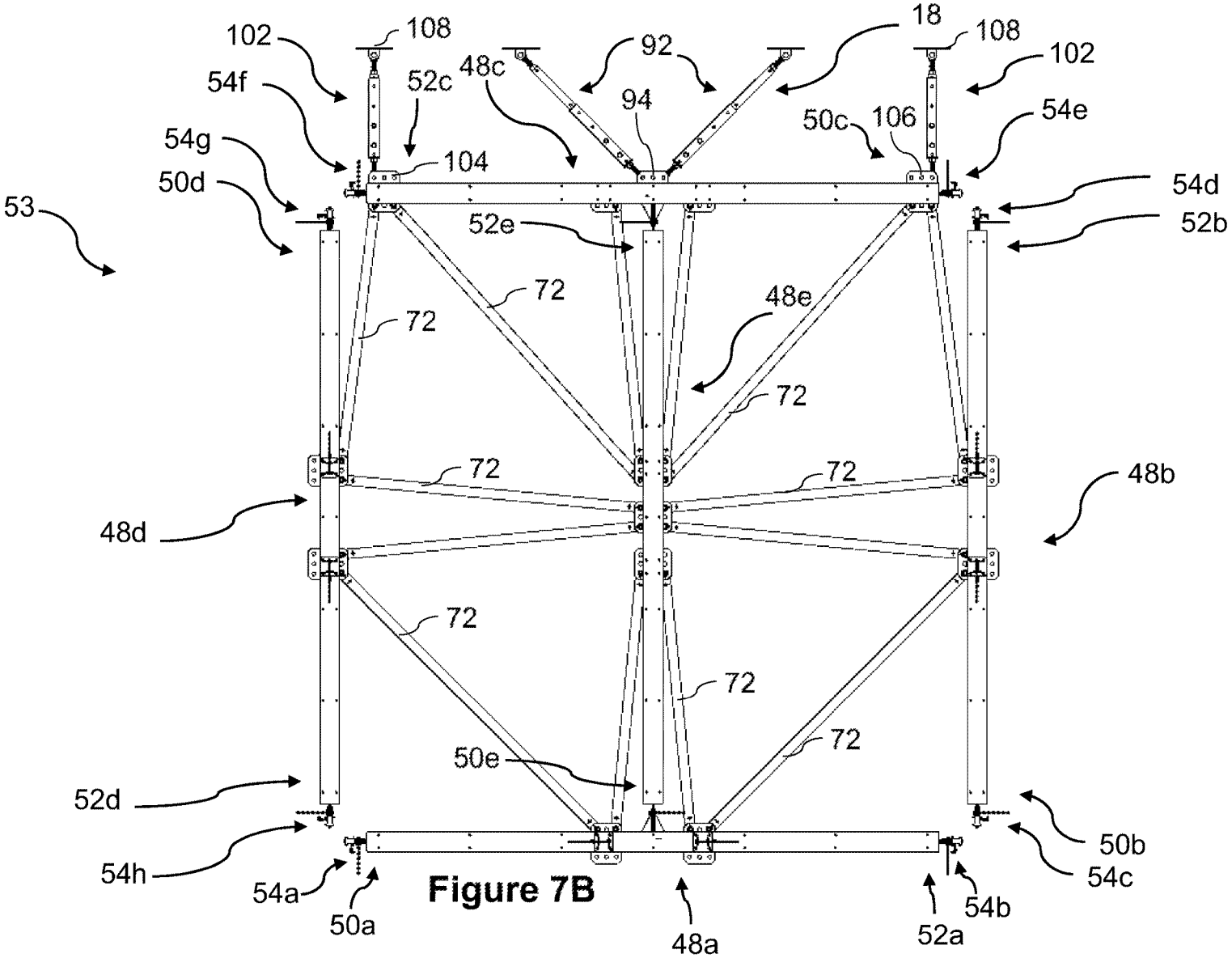
FIG. 7B is a top plan view of the primary beam sections and further of the secondary beam sections shown in FIG. 7A.

Referring now more particularly to FIGS. 7A and 7B, there is shown that flooring structure 14 further comprises a plurality of secondary beam sections 72, namely the secondary landing beam sections, which are releasably connected to primary beam sections 48*a*, 48*b*, 48*c*, 48*d*, 48*e* (via connectors 73) in a way to secure the primary beam sections together before, during and after their releasable sliding connection with columns 12*a*, 12*b*, 12*c*, 12*d*. The secondary beam sections together with the primary beam sections (first and second landing beams) together form the deck supporting structure.

Figure 9A:
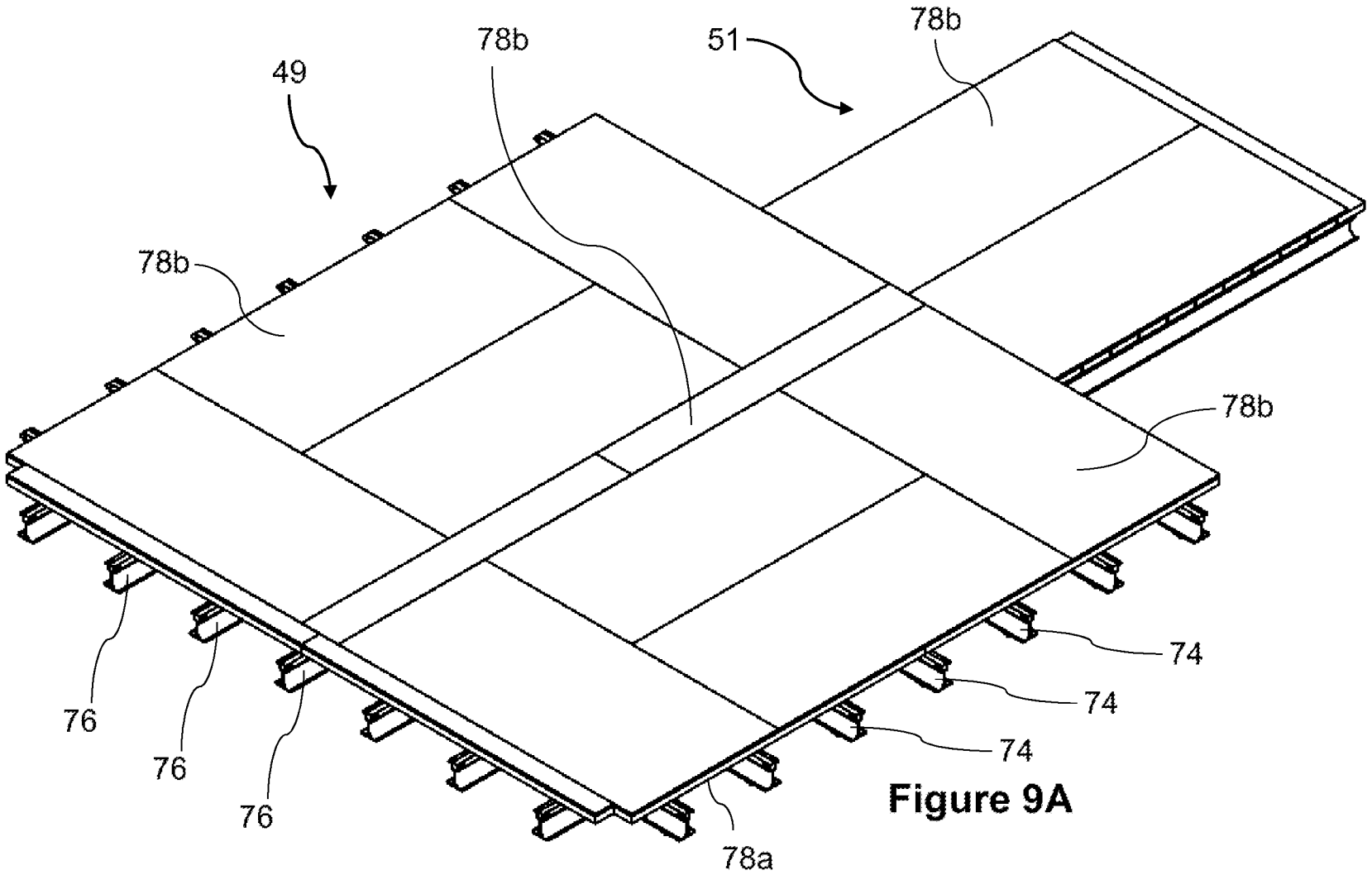
FIG. 9A is a top perspective view of a main deck and of a secondary deck that are adapted to be releasably mounted on the deck supporting structure shown in FIGS. 7A-7B.
Figure 9B:
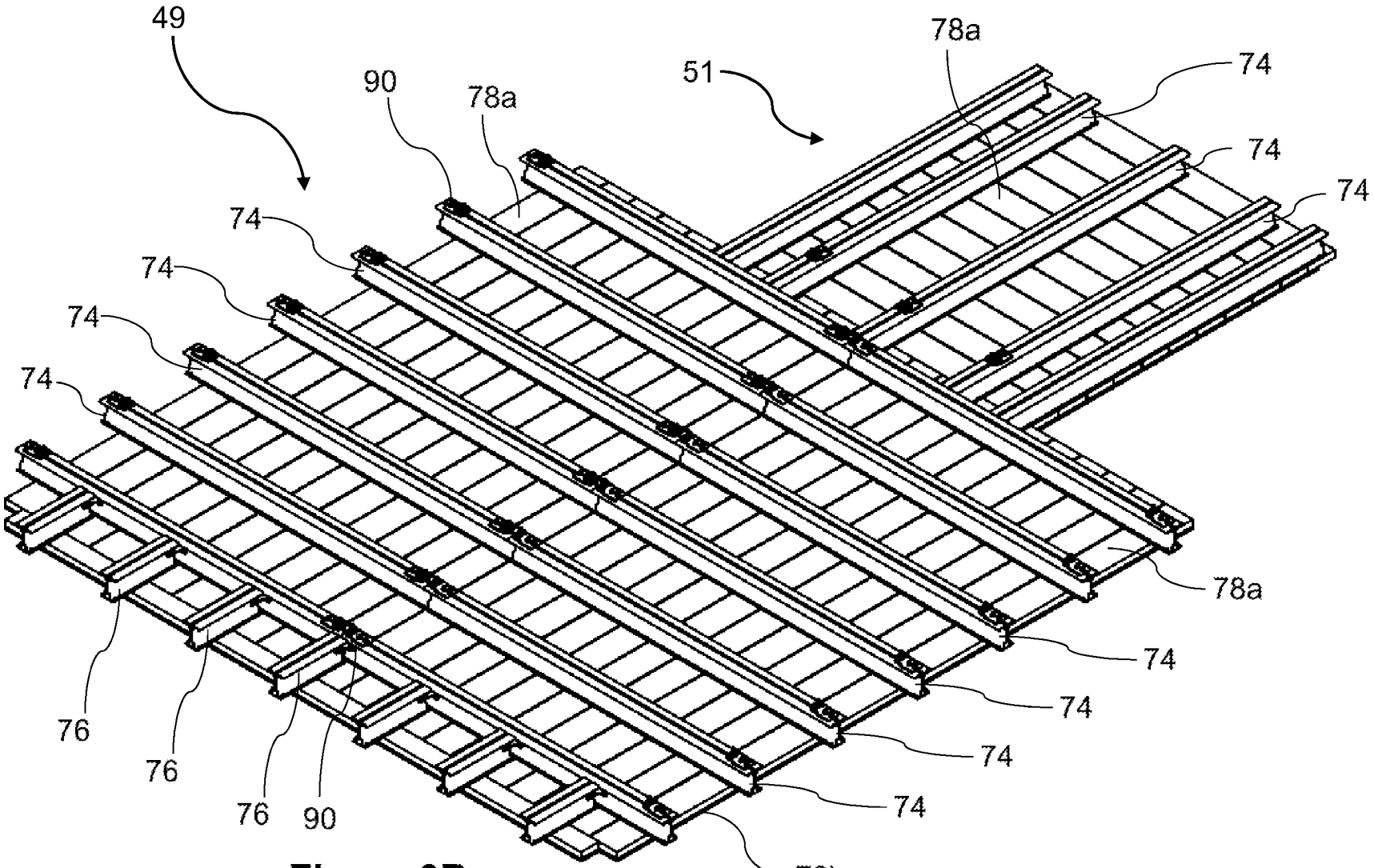
FIG. 9B is a bottom perspective view of the main deck and of the secondary deck shown in FIG. 9A that are adapted to be releasably mounted on the deck supporting structure shown in FIGS. 7A-7B.

Now referring to FIGS. 9A and 9B, there is shown that each flooring structure 14 (here illustrated as comprising a main deck 49 and a secondary deck 51 or deck extension, that extends from primary deck 49) further comprises a plurality of spaced apart primary floor supporting elongated members 74, namely the primary ledger beams, which are configured to be releasably supported by, or mounted on, primary beam sections 48*a*, 48*b*, 48*c*, 48*d*, 48*e* or at least some of them (and further supported by secondary beam sections 72). Flooring structure 14 further comprises a plurality of spaced apart secondary floor supporting elongated members 76, namely the secondary leger beams, which are configured to be supported by, or mounted on, a primary beam section (48*a*) and perpendicularly and releasably connected to a primary floor supporting elongated member 74 (the one adjacent primary beam section 48*a*).

Figure 9C:
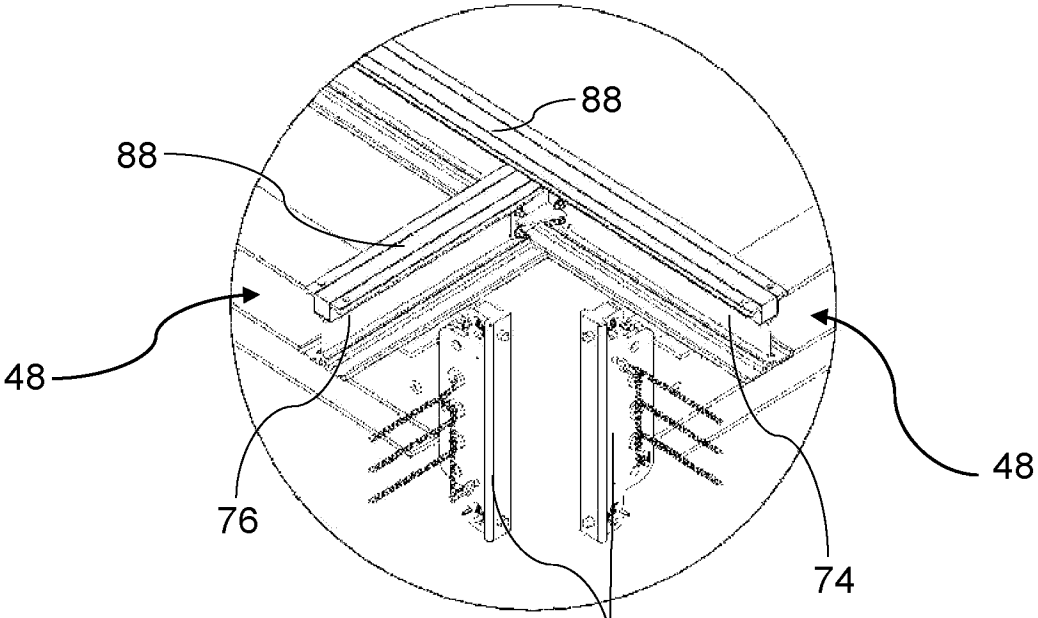
FIG. 9C is a closed-up perspective view of primary and secondary floor supporting elongated members (the ledger beams) shown in FIG. 9B that are releasably mounted on the primary beam sections.
Figure 9D:
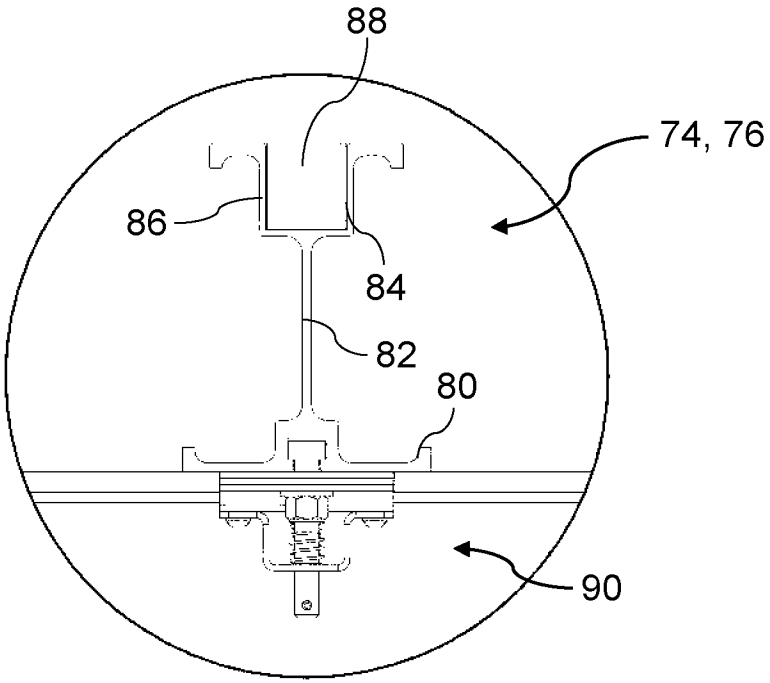
FIG. 9D is an elevation view of a primary/secondary floor supporting elongated member shown in FIG. 9B that is releasably mounted on a primary beam section.

As better shown in FIGS. 9B, 9C and 9D, each primary/secondary floor supporting elongated member 74, 76 (FIG. 9D) comprises a base member 80, a wall section 82 which upwardly extends from base member 80, and a top member 84 supported by (extending from) wall section 82. Top member 84 defines a top member longitudinal groove 86 which is adapted to receive an elongated wood strip 88. Flooring structure 14 therefore further comprises a plurality of pressure release connectors 90 (FIGS. 9B, 9D) that are adapted to releasably connect with respectively the primary floor supporting elongated members 74, the primary ledger beams, and the primary beam sections (48*b*, 48*d*, 48*e*) in order to releasably connect primary/secondary floor supporting elongated members 74, 76 to, or to mount them on, primary beam sections, and the secondary beam seconds 72. Indeed, referring to FIG. 9B, there is shown that, for each primary floor supporting elongated member 74, two pressure release connectors 90 are releasably connected thereon (one at each end) so the primary/secondary floor supporting elongated members may be releasably connected to primary beam sections 48*b*, 48*d*, 48*e*.

Still referring to FIGS. 9A and 9B, there is shown that flooring structure 14 further comprises a plurality of flooring elements 78*a*, 78*b* that can be supported by or fixed (secured to) the primary and secondary floor supporting elongated members 74, 76. A first layer of flooring elements 78*a* such as, without limitation, wood planks, are fixedly or releasably secured (using nails, screws or the like) on a perpendicular manner on top of primary and secondary floor supporting elongated members 74, 76 by nailing or screwing flooring elements 78*a* onto elongated wood strips 88 that are introduced within top member longitudinal groove 86 of primary and secondary floor supporting elongated members 74, 76 (FIGS. 9C and 9D). A second layer of flooring elements 78*b* such as, without limitation, plywood sheets, are fixedly or releasably secured (using nails, screws or the like) on top of first layer of flooring elements 78*a*.

Still referring to FIGS. 9A and 9B, flooring structure 14 may include a main deck 49 and further a deck extension 51 that may be releasably connected to main deck 49. Main deck 49 will be responsible of regrouping/receiving the hoisting equipment, while deck extension 51 will be responsible of providing a bridge between main deck 49, receiving workers and materials, and the building structure itself.

Therefore, when assembling the components of flooring structure 14 together, sliding members 54*a*, 54*b*, 54*c*, 54*d*, 54*e*, 54*f*, 54*g*, 54*h* are releasably connected to their respective beam first and second ends 50*a*, 52*a*, 50*b*, 52*b*, 50*c*, 52*c*, 50*d*, 52*d* (FIGS. 6A and 6B), using pin-like members 70, as they are here used to releasably connect each sliding member 54 with a beam end 50 that is introduced within beam receiving groove 57 of sliding member 54 (FIG. 8E). Pin-like members 70 are introduced within spaced apart sliding member apertures 66 and further within corresponding spaced apart beam apertures 68 that are aligned one with another.

As shown in FIGS. 7A and 7B, primary beam sections 48*a*, 48*b*, 48*c*, 48*d*, 48*e* (primary landing beams) are perpendicularly positioned one relatively to another so that the plurality of secondary beam sections 72 (secondary landing beams) may releasably connect the primary beam sections 48*a*, 48*b*, 48*c*, 48*d*, 48*e* together, via connectors 73, and maintain them in a perpendicular relationship one to another.

Now referring to FIGS. 9A and 9B, main deck 49, and alternatively main deck 49 and secondary deck 51, via their primary floor supporting elongated members 74, are positioned over primary beam sections 48*a*, 48*b*, 48*c*, 48*d*, 48*e* that are releasably linked with secondary beam sections 72, so that primary floor supporting elongated members 74 are spaced apart and parallel one to another, but also perpendicular to primary beam sections 48*b*, 48*d*, 48*e*. Once base members 80 of all primary floor supporting elongated members 74 are releasably secured to primary beam sections (48*b*, 48*d*, 48*e*) and to secondary beam sections 72 using spaced apart pressure release connectors 90 (FIGS. 9B, 9D), main deck 49 and secondary deck 51 are strongly secured to the deck supporting structure, made of the primary beam sections 48*a*, 48*b*, 48*c*, 48, 48*e*, the secondary beam sections 72 and the connectors 73. Elongated wood strips 88 were prior inserted into top member longitudinal grooves 88 formed within top members 84 of primary and secondary floor supporting elongated members 76, 78, so that first and second layers of flooring elements 78*a*, 78*b* may be supported by primary and secondary floor supporting elongated members 74, 76. Indeed, flooring elements 78*a* such as, without limitation, wood planks, were fixedly or releasably (using nails, screws or the like) secured on a perpendicular manner on top of primary and secondary floor supporting elongated members 74, 76 by nailing or screwing wood planks onto elongated wood strips 88 introduced within longitudinal groove members 86 of primary and secondary floor supporting elongated members 74, 76. Plywood sheets 78*b*, for instance, may therefore be fixedly or releasably (using nails, screws or the like) secured on the wood planks. It is to be noted that a person skilled in the art to which the common tower assembly pertains would understand that flooring structure 14 may be assembled according to different steps order (1—providing the deck supporting structure using the landing beams; 2—mounting the ledger beams onto the landing beams; 3—fixing the flooring elements to the ledger beams vs. 1—providing the deck supporting structure using the landing beams; 2—fixing the flooring elements to the ledger beams; 3—mounting the ledger beams onto the landing beams).

Figure 10B:
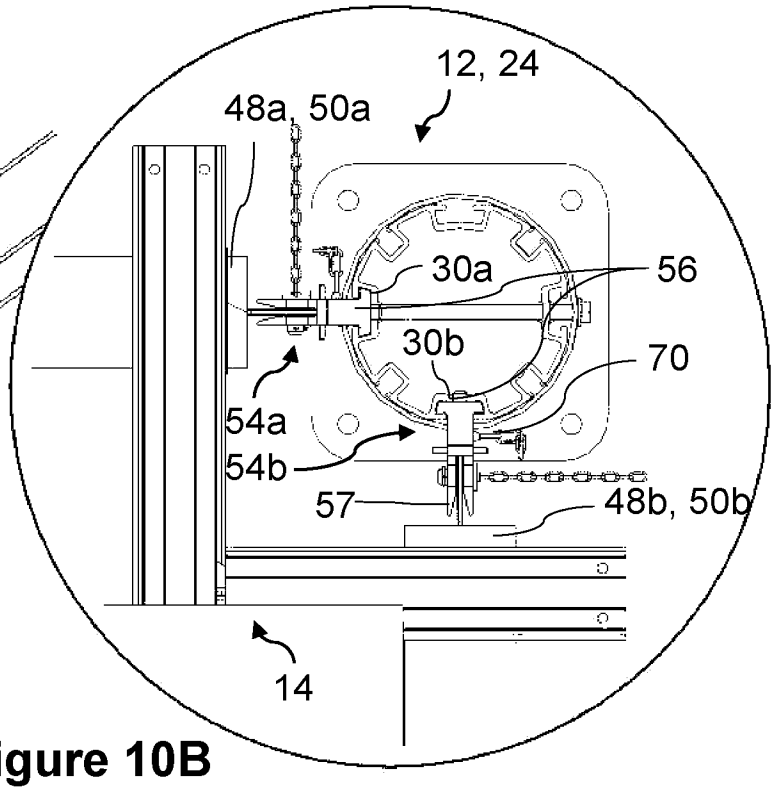
FIG. 10B is a top plan view of the flooring structure shown in FIG. 10A that is releasably and slidably connected to the column.
Figure 10A:
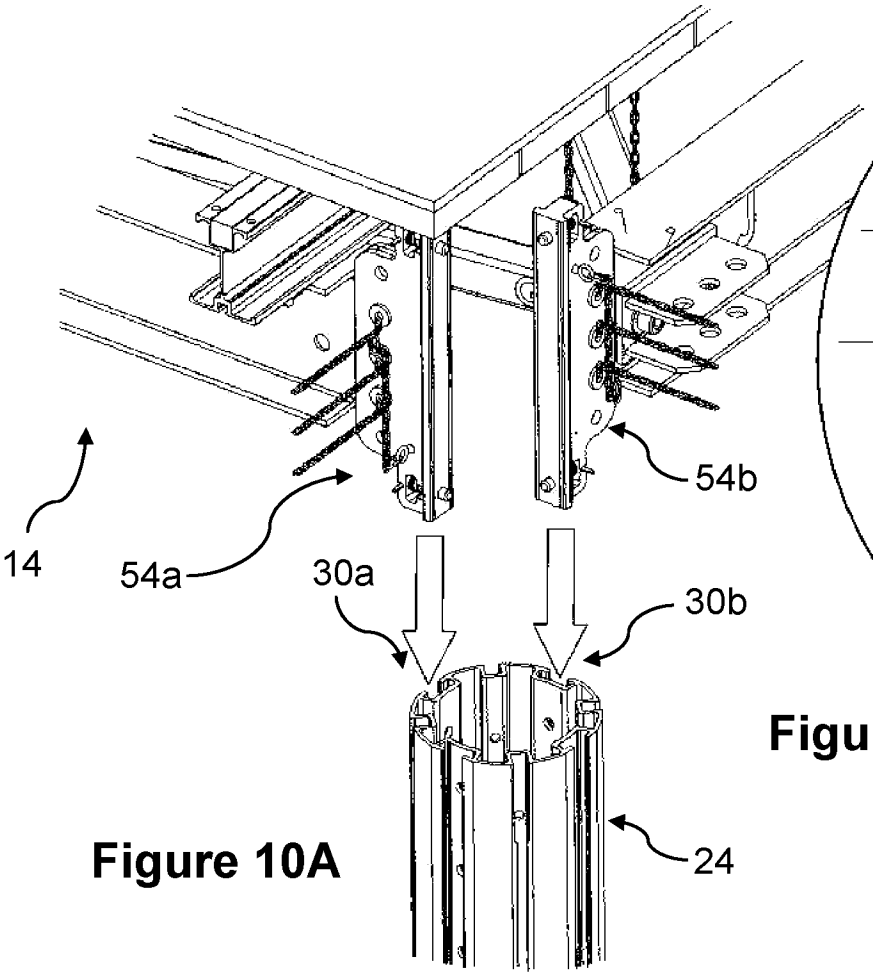
FIG. 10A is a perspective view showing a flooring structure that is to be releasably and slidably connected to a column.

Referring now to FIGS. 10A and 10B, once flooring structure 14 (or part of a flooring structure 14) is assembled for one common tower floor, a pair of sliding members 54*a*, 54*b* is installed, on each column 12*a*, 12*b*, 12*c*, 12*d*, by downwardly sliding longitudinal sliding surface or elongated portion 56 of sliding members 54*a*, 54*b* along longitudinal grooves 30*a*, 30*b* of column hollow section 24, sliding through grooves 30*a*, 30*b* (3" sliding adjustment for a main beam/sliding member assembly and for up to 6" adjustment for a sliding member/column hollow section assembly). Therefore, when first and second spring loaded pins 62, 64 of sliding members 54*a*, 54*b* are disengaged from longitudinally aligned column hollow section 24, primary beam sections 48*a*, 48*b* are capable of horizontal displacement within grooves 30*a*, 30*b*. One may turn them to lock sliding members 54*a*, 54*b* in place (one flooring is aligned with a corresponding building level).

Figure 12:
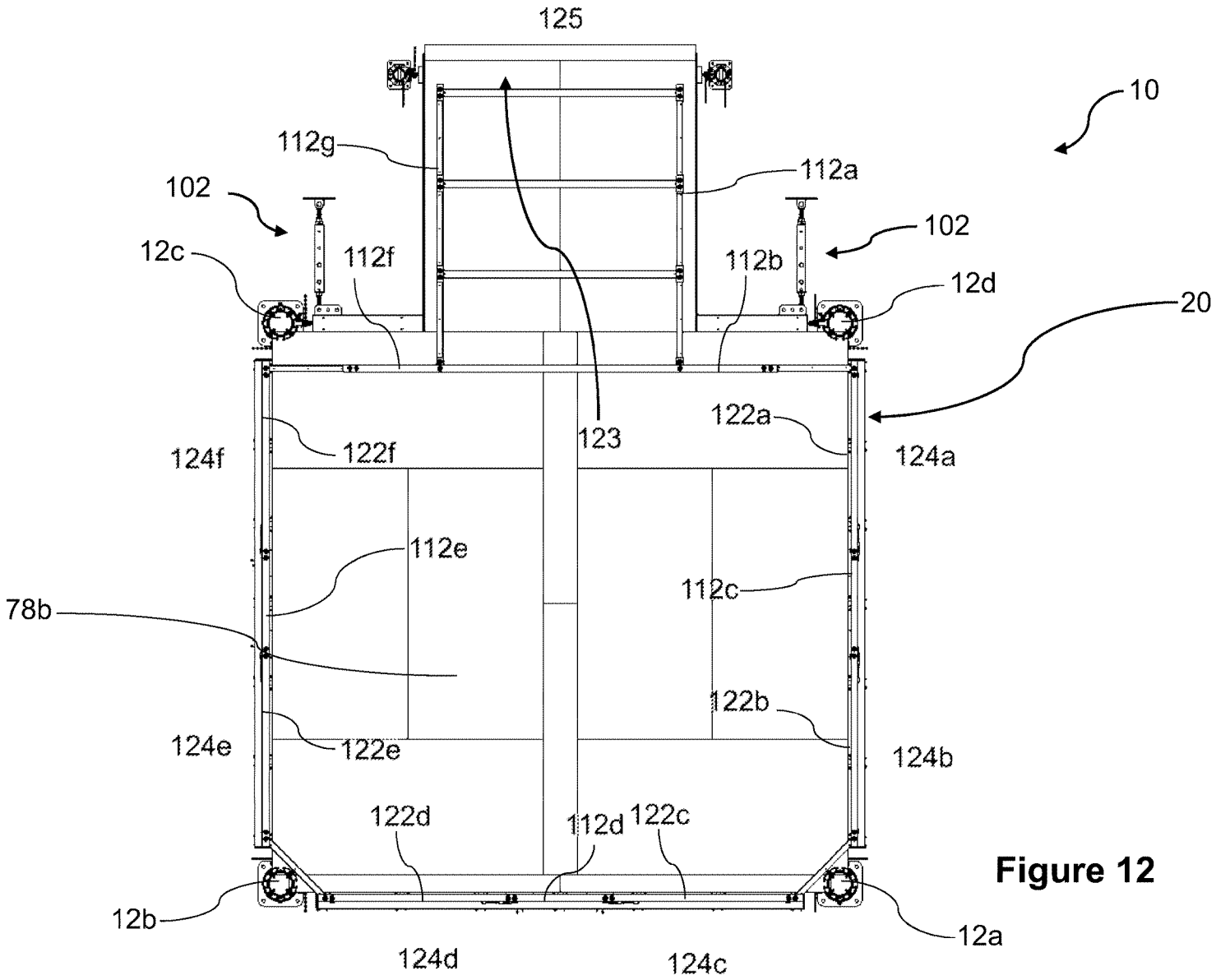
FIG. 12 is a top plan view of the common tower shown in FIGS. 1 and 2, where six hoisting machines that are tied to and grouped around the tower are schematically illustrated.
Figure 13:
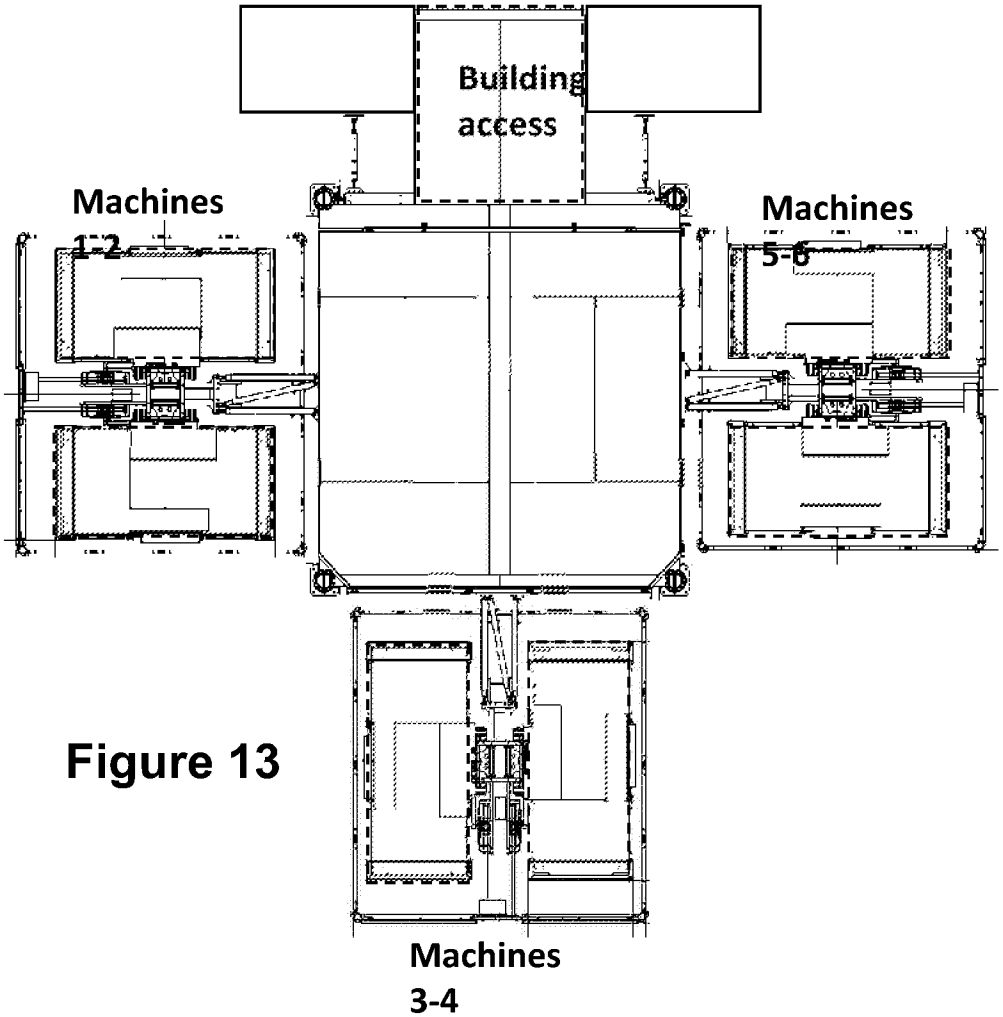
FIG. 13 is a top plan view of a common tower that is assembled/erected and mounted/positioned adjacent a building structure, showing six hoisting equipment, facilities and/or machines tied to and grouped around the tower.

Referring now more particularly to FIGS. 7A, 7B, 12, there is shown anchoring system 18 that is releasably connected to a primary beam section 48*c*. Anchoring system 18 is configured to be anchored with the wall of a building structure and comprises a set of main arms 92 that are independently pivotably and releasably connected to a first anchoring member 94, which is releasably mounted on primary beam section 48*c*. Main arms 92 each comprises a plurality of main arm sections 96, as well as an anchoring plate 98 pivotably extending from distal main arm sections 96. Anchoring plates 98 each define a set of apertures 100, so that fasteners may be used to anchor anchoring plates 98 to the wall of the building structure. Anchoring system 18 further includes a set of secondary arms 102 that are independently pivotably and releasably connected to second and third anchoring members 104, 106, which are also releasably mounted on primary beam section 48*c*, distant from first anchoring member 94. Secondary arms 102 each comprises a plurality of secondary arm sections, as well as an anchoring plate 108 pivotably extending from secondary arms 102. Anchoring plates 108 each defines a set of apertures 110, so that fasteners may be used to anchor anchoring plates 108 to the wall of the building structure. The tower structure may therefore be anchored to the wall of the building with multiple configurations turnbuckles (possible displacement of the system in the x, y, and z axis).

Figure 11A:
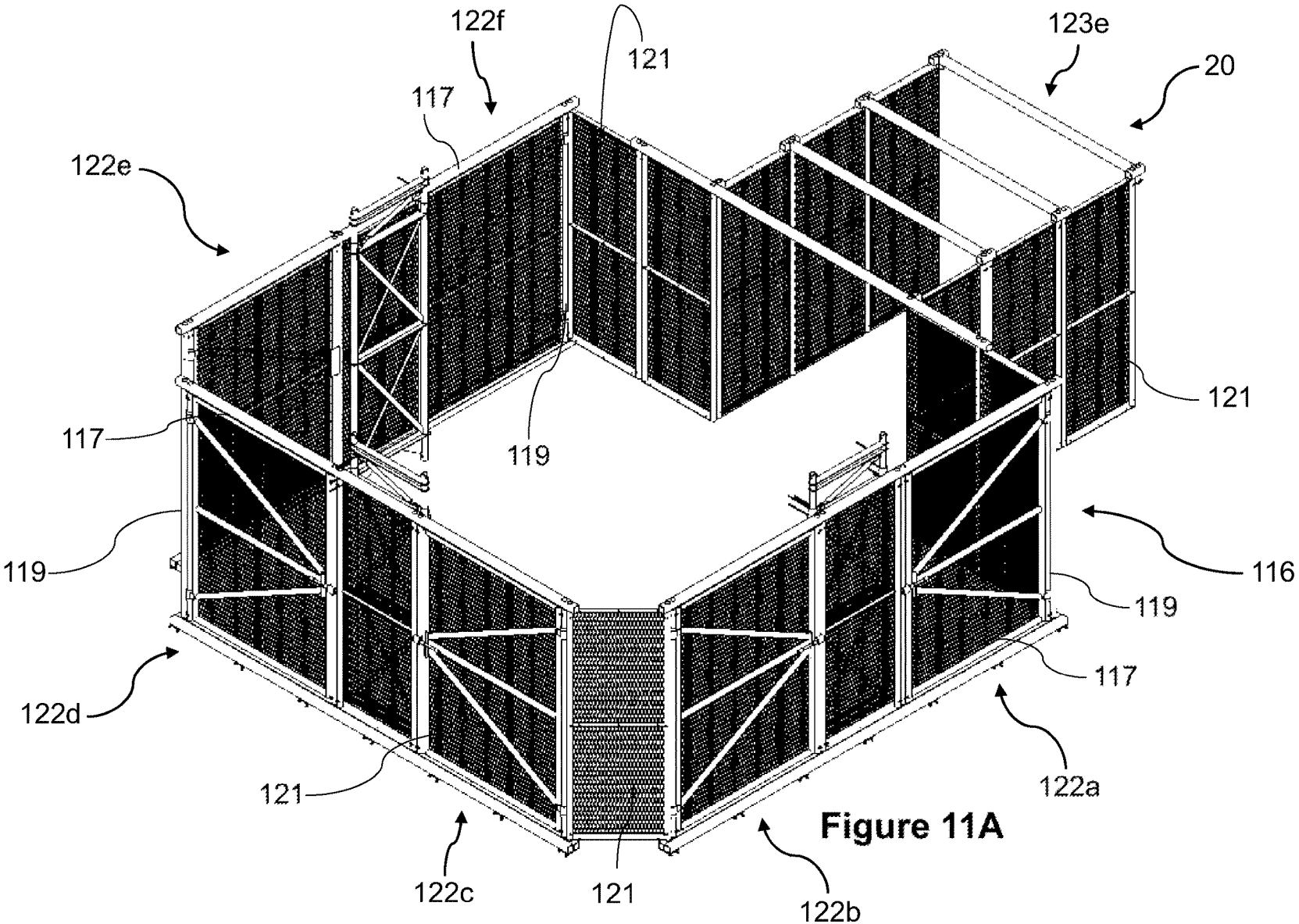
FIG. 11A is a top perspective view of a protection structure adapted to surround main and secondary decks being part of the flooring structure in accordance with another embodiment.
Figure 11B:
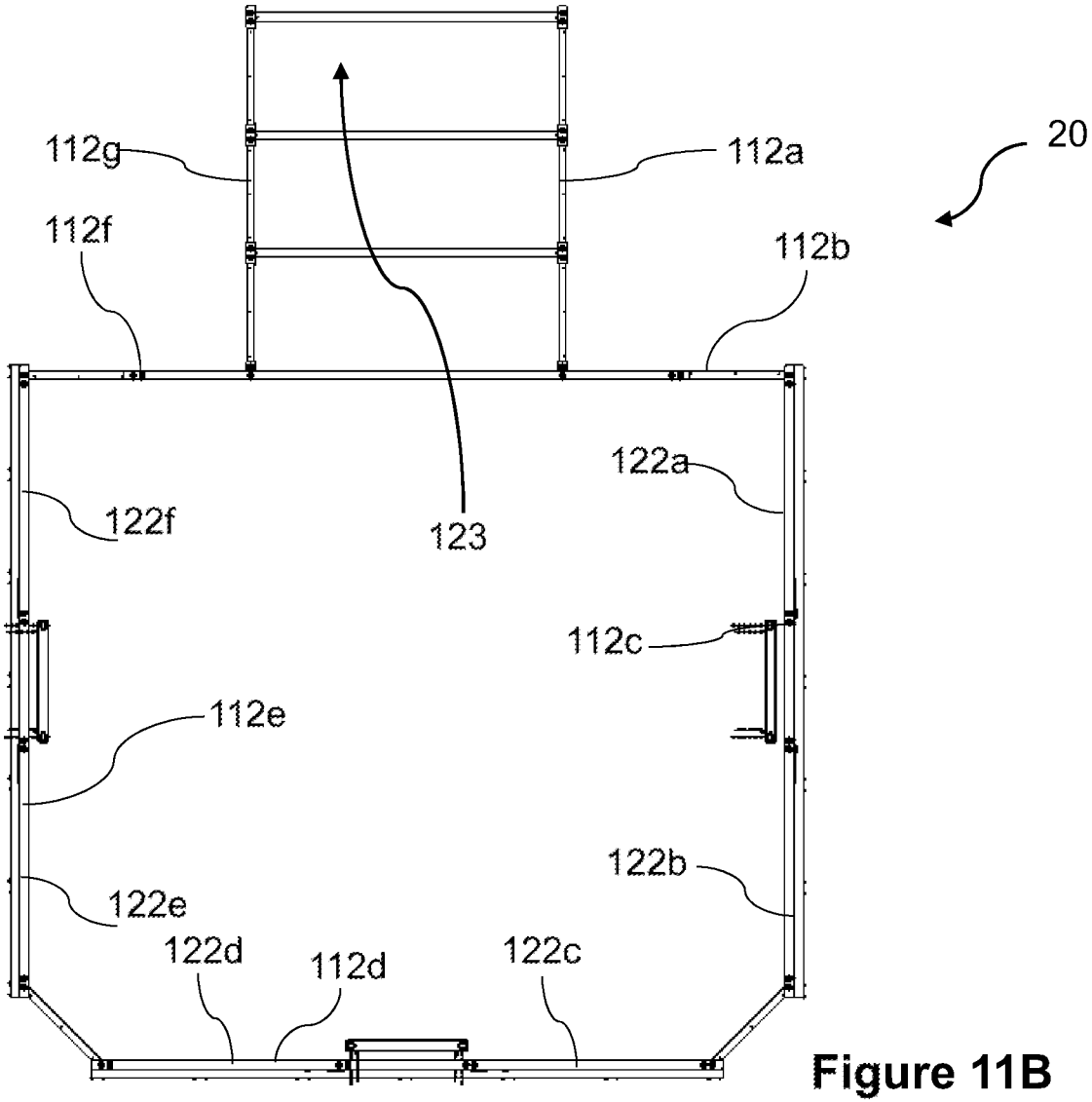
FIG. 11B is a top plan view of the protection structure shown in FIG. 11A.
Figure 11C:
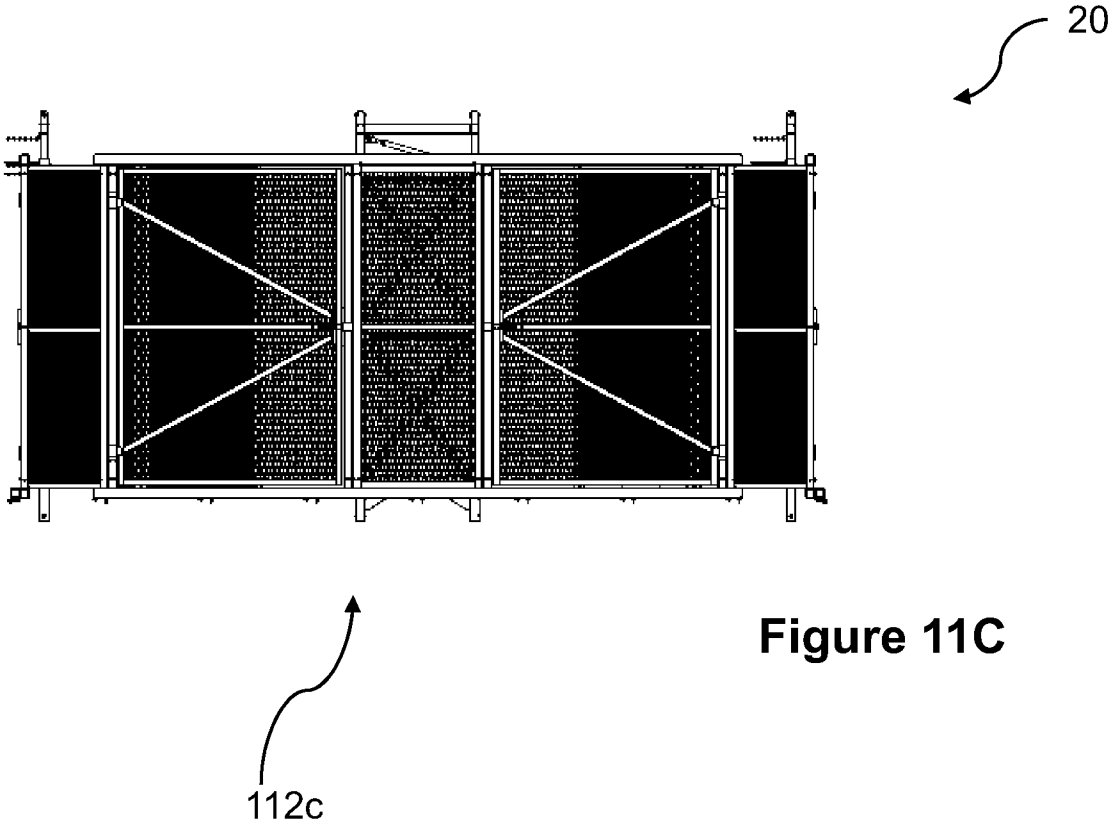
FIG. 11C is an elevation view of the protection structure shown in FIG. 11A.

As mentioned above and referring now to FIGS. 1, 2, 11A, 11B, 11C, and 12, tower 10 comprises protection structures 20*a*, 20*b*, 20*c* (or 20) that are releasably mounted on each flooring structure 14*a*, 14*b*, 14*c* (and/or slidably connected to columns 12*a*, 12*b*, 12*c*, 12*d*) so as to upwardly extend from the flooring structures. As better shown in FIGS. 11A, 11B, 11C, each protection structure 20 comprises protection walls 112*a*, 112*b*, 112*c*, 112*d*, 112*e*, 112*f*, 112*g*. Protection walls 112*a*, 112*b*, 112*c*, 112*d*, 112*e*, 112*f*, 112*g* each comprises a main frame 116 defining a plurality of horizontally oriented members 117 and a plurality of vertically oriented members 119. First and second opposite edges of each wall adjacent a column may be adapted to slidably engage with spaced apart secondary longitudinal grooves 31*a*, 31*b*, 31*c*, 31*d* of column hollow sections 24 by downwardly sliding first and second opposite edges along longitudinal grooves 31*a*, 31*b*, 31*c*, 31*d*. Other connection possibilities between the protection walls and the columns and/or the flooring structure may be provided. For example, the protection wall may be releasably mounted directly on the flooring structure, so they upwardly extend from the flooring elements 78*a*, 78*b*. Protection walls 112*a*, 112*b*, 112*c*, 112*d*, 112*e*, 112*f*, 112*g* each further comprises a protection that is connected to the horizontally and vertically oriented members 117, 119, such as, without limitation, a protection mesh, glass or membrane (that is fixed to main frame 116). Also, as shown, main frame 116, for some protection walls (112*c*, 112*d*, 112*e*) defines one or more openings or doors 122*a*, 122*b*, 122*c*, 122*d*, 122*e*, 122*f* so that workers can have access to the building structure 125 via building access 123 (FIG. 12). A sturdy protection may therefore protect the whole landing area, even around the extension deck.

Referring now more particularly to FIG. 12, according to its configuration, tower 10, once erected/assembled, enable installation of up to six hoisting machines 124*a*, 124*b*, 124*c*, 124*d*, 124*e*, 124*f* (such as transport platform, construction elevator and the like) of the same type on a single common tower structure, where all hoisting machines are able to share a single access point 123 to building structure 125, up to a 1500' elevation.

According to its novel configuration and components, tower 10, once assembled, brings an improved solution for high-rise installation. Indeed, it enables multiple machines of the same type to be used together as part of the same installation. It further provides less openings on the building structure's walls. The design of the plurality of components, namely, the spaced apart columns (and the column sections), the vertically spaced apart flooring structures (and their components, namely the sliders, the landing beams, the ledger beams, etc.), the anchoring system, the protection structure as well as the plurality of connectors, leads to a faster installation of the tower that requires less fasteners, thanks to, for example, the sliding members that releasably and slidably connect each one of the flooring structures to the spaced apart columns 12*a*, 12*b*, 12*c*, 12*d*, as well as to a faster installation. Tower 10 may further be erected/assembled by a reduced number of workers and machinery (tool-less erection), thanks to the light weighted components, mostly made of aluminum extruded components/parts. Indeed, one 6-feet column hollow section weights about 130 pounds (in comparison, a mast section used for prior art towers may weight up to about 400-500 pounds for a 5-feet section). Safer use and installation of the tower itself is further provided, thanks to easy to install protection structures or meshes (that are configured to be slidably and releasably, or alternatively mechanically, connected to the columns and/or the flooring structures) and to the chain retaining pins that prevent falling fasteners during and/or after installation of the tower onsite. Flexibility of the tower design are further provided.

Figure 14A:
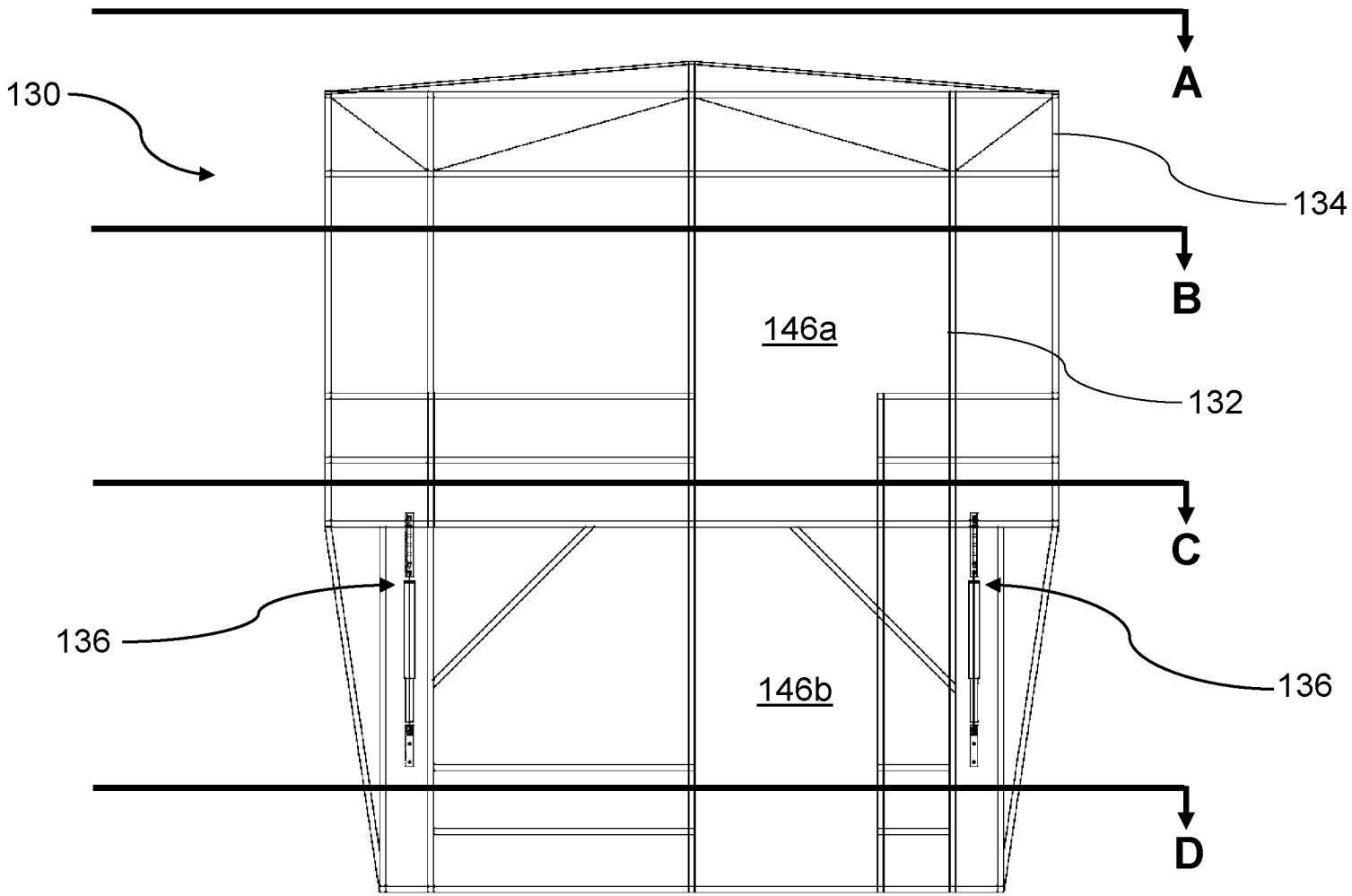
FIG. 14A is an elevation view of a protection enclosure that is adapted to be releasably and slidably connected to the partly assembled columns as the common tower is erected.
Figure 14B:
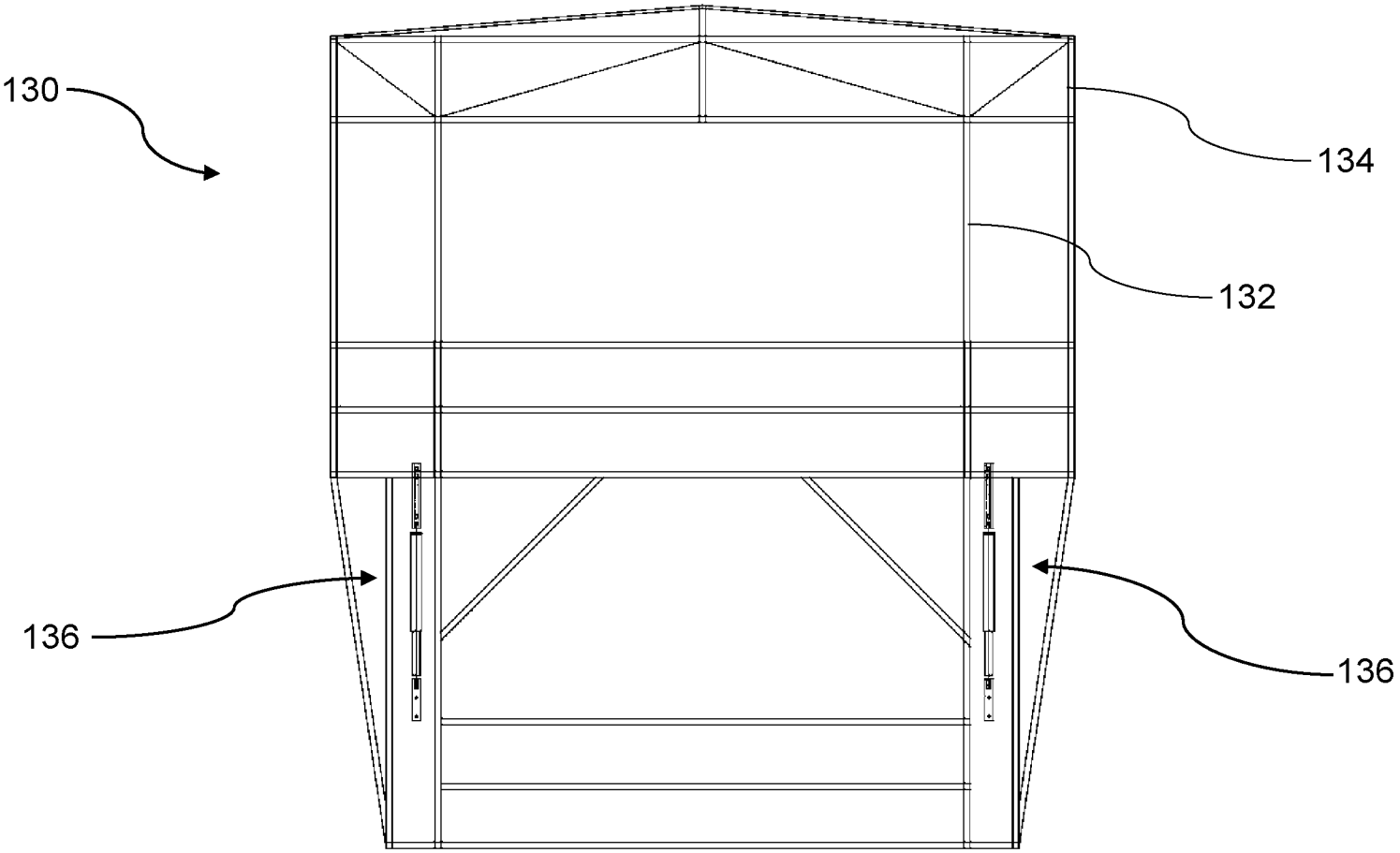
FIG. 14B is another elevation view of the protection enclosure shown in FIG. 14A.
Figure 14C:
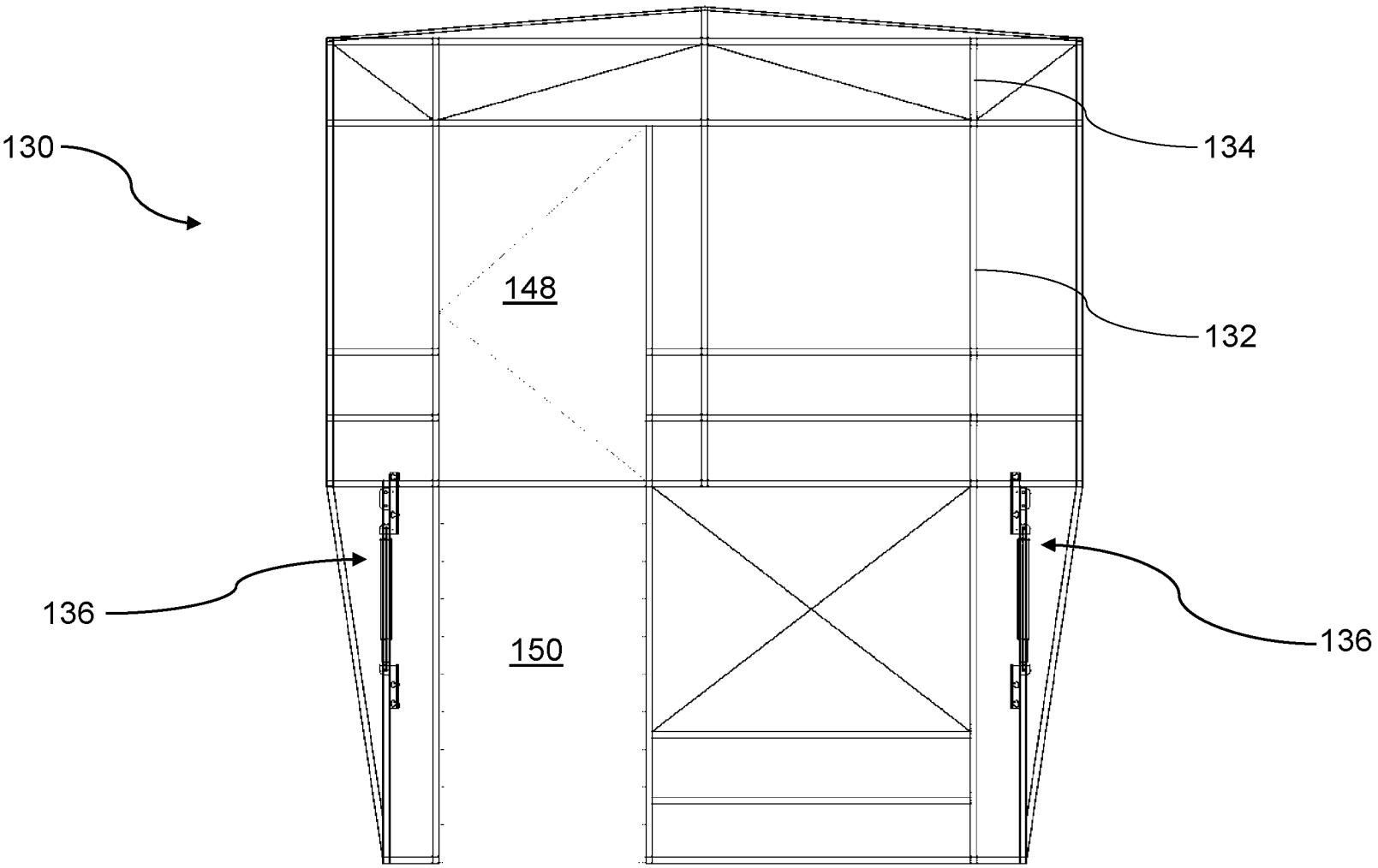
FIG. 14C is a further elevation view of the protection enclosure shown in FIG. 14A.
Figure 14E:
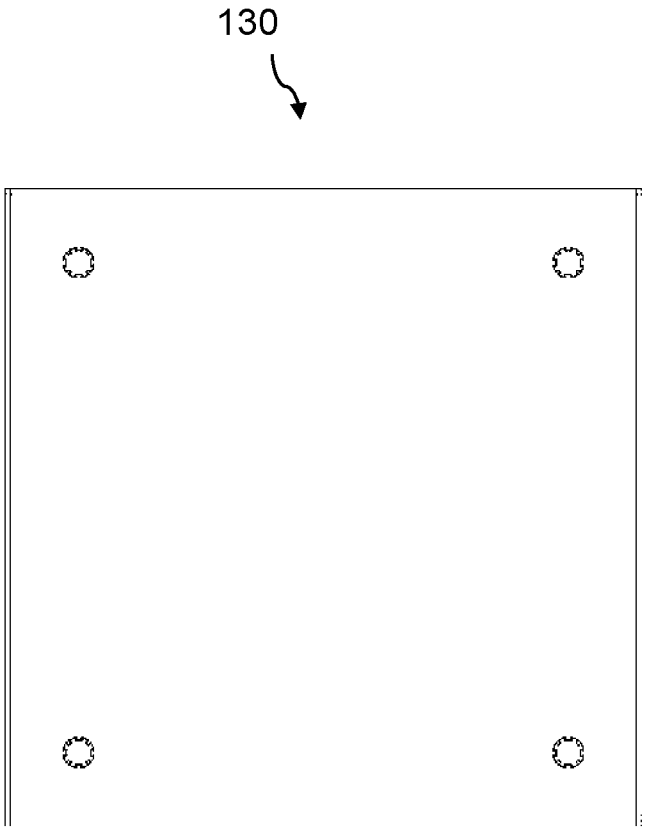
FIG. 14E is a cross-sectional view of the protection enclosure shown in FIG. 14A, taken along line B.
Figure 14D:
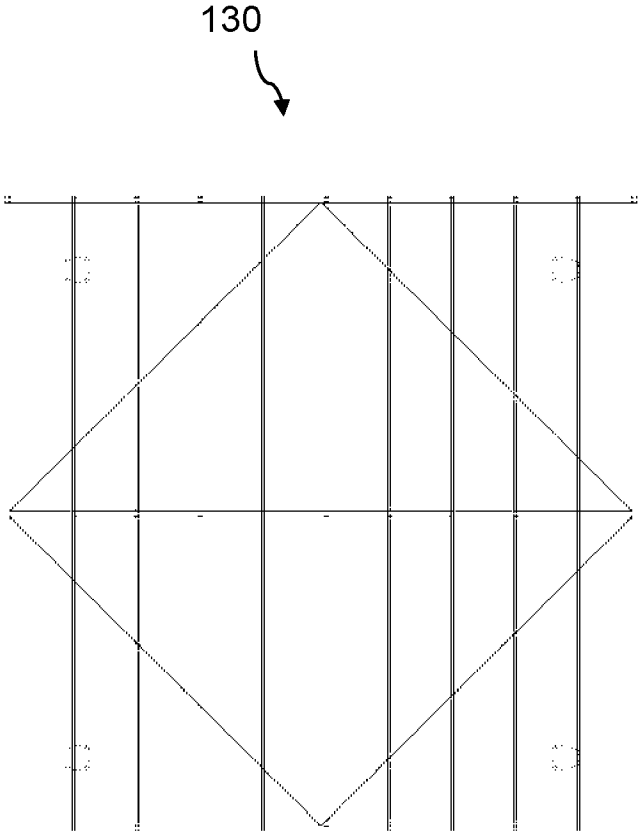
FIG. 14D is a cross-sectional view of the protection enclosure shown in FIG. 14A, taken along line A.
Figure 14G:
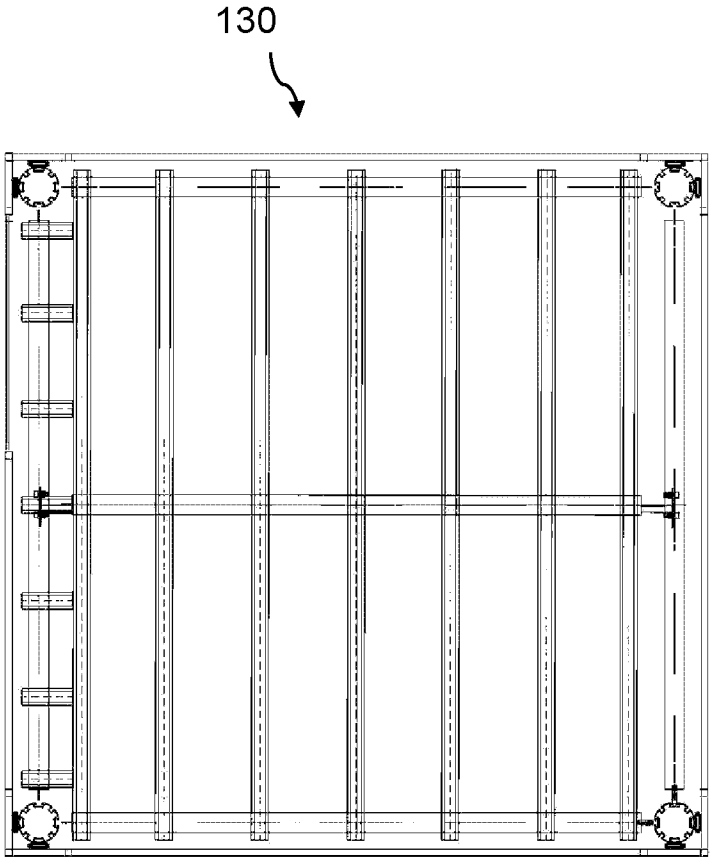
FIG. 14G is a cross-sectional view of the protection enclosure shown in FIG. 14A, taken along line D.
Figure 14F:
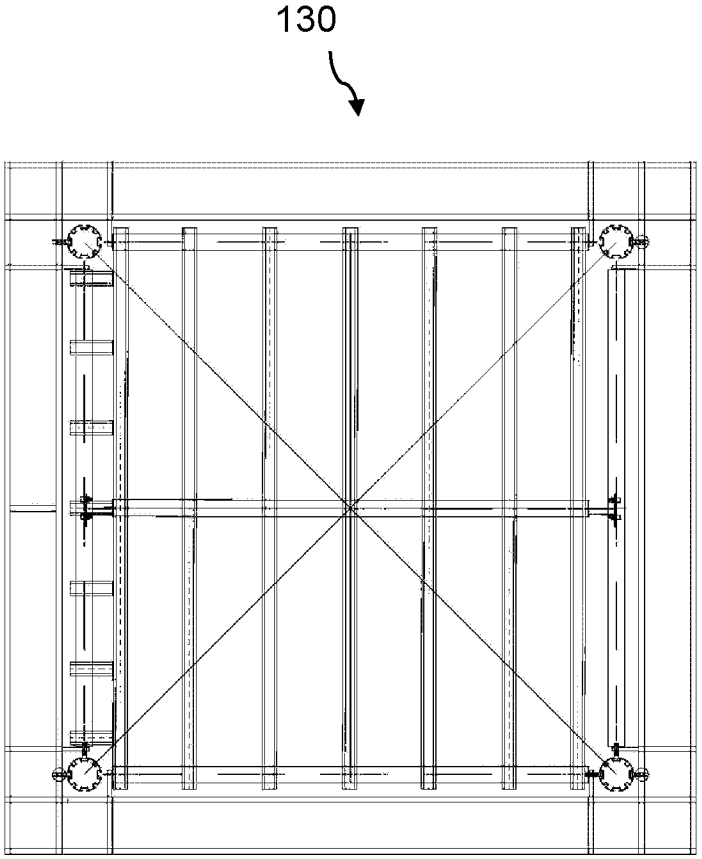
FIG. 14F is a cross-sectional view of the protection enclosure shown in FIG. 14A, taken along line C.
Figures 15A, 15B:
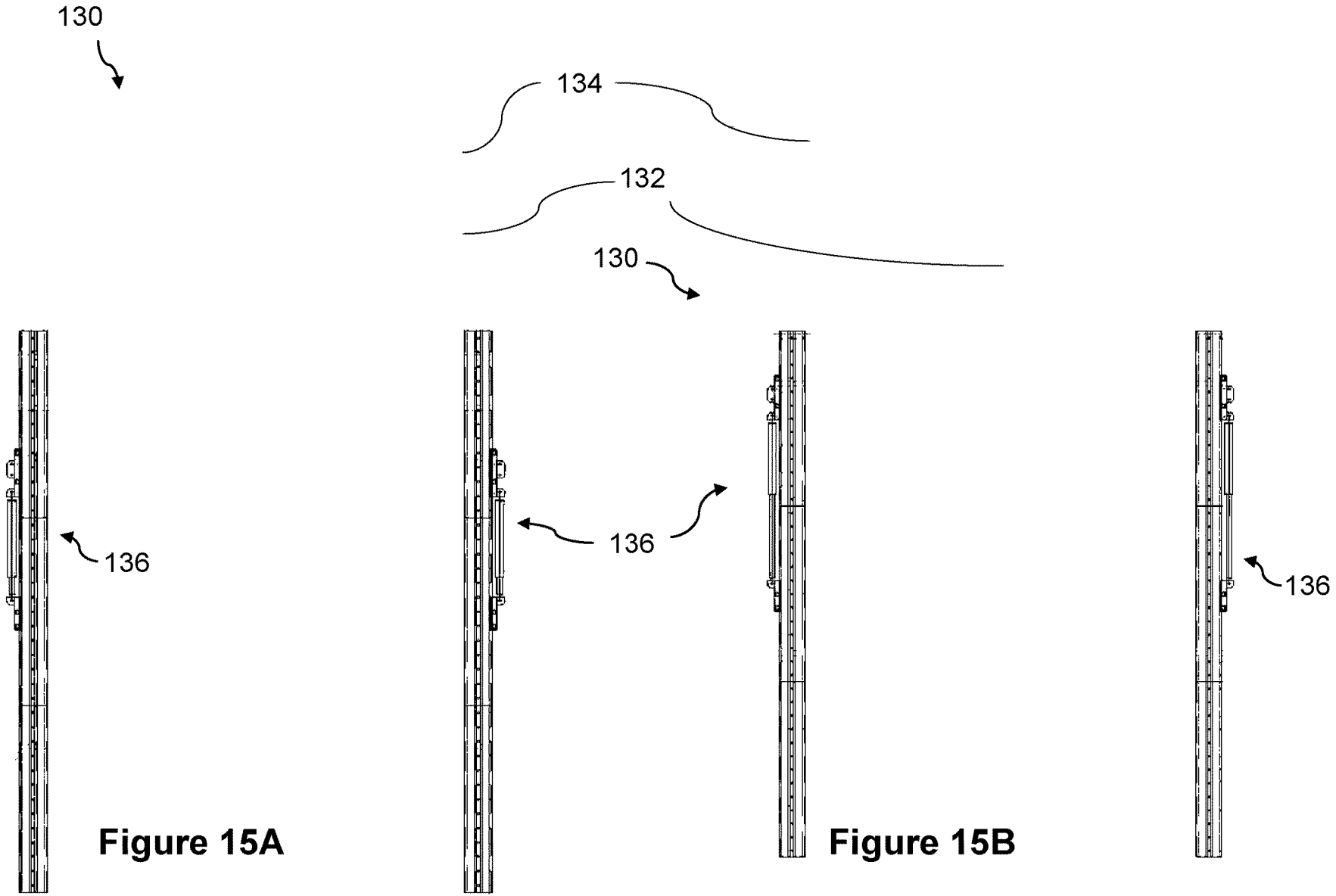
FIG. 15A is a closed-up view of the protection enclosure shown in FIGS. 14A-14C, showing lifting assemblies that are positioned in their compressed positions.
FIG. 15B is a closed-up view of the protection enclosure shown in FIGS. 14A-14C, showing lifting assemblies that are positioned in their extended positions.
Figure 15C:
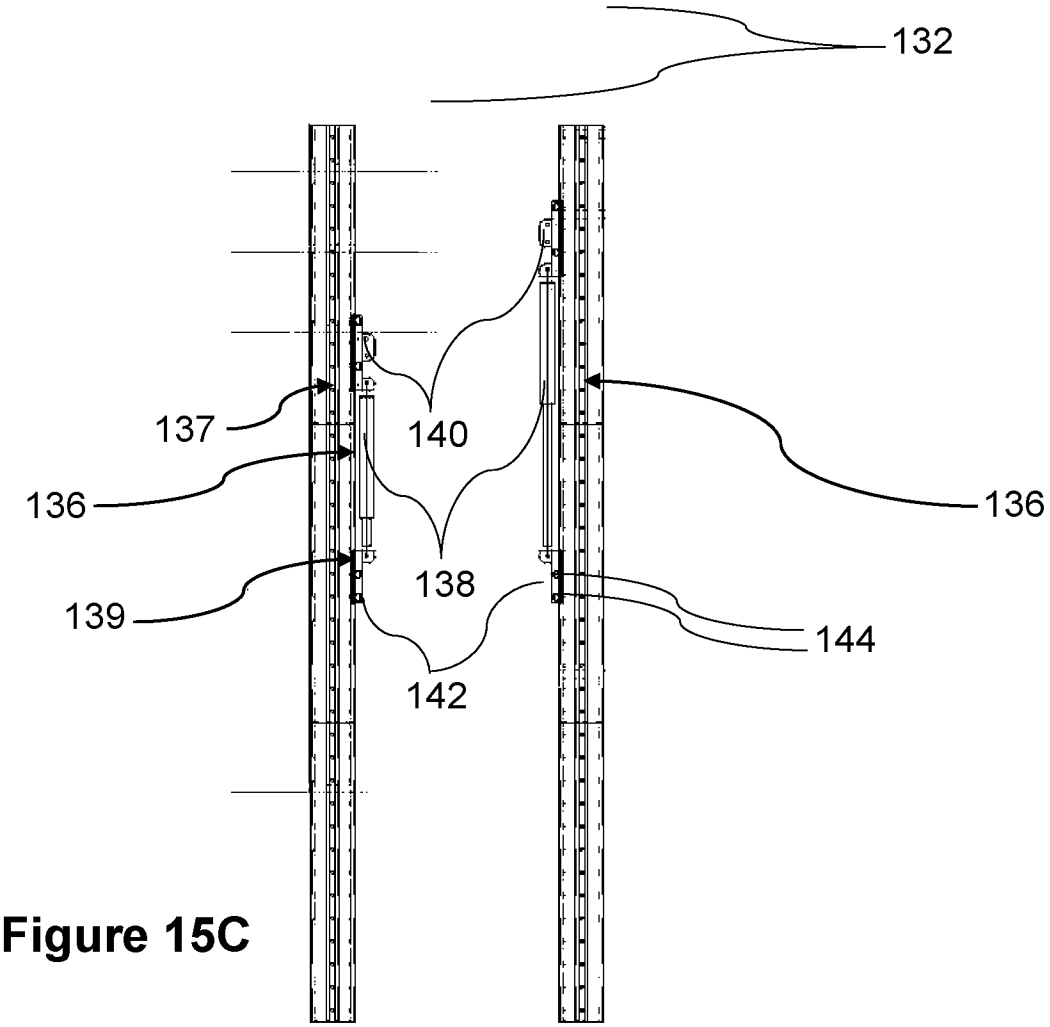
FIG. 15C is a closed-up view of the lifting assemblies shown in FIGS. 15A-15B.

Referring now more particularly to FIGS. 14A-14G and to FIGS. 15A-15C, there is shown a protection enclosure 130 that is designed to provide a safe erection of common tower 10. Indeed, protection enclosure 130 is configured to be releasably and slidably supported by spaced apart columns 12*a*, 12*b*, 12*c*, 12*d*, when erecting tower 10, before all flooring structures 14*a*, 14*b*, 14*c*, etc. (FIGS. 1 and 2) are releasably secured to spaced apart columns 12*a*, 12*b*, 12*c*, 12*d*. Protection enclosure 130 is capable of vertical displacement relatively to spaced apart columns 12*a*, 12*b*, 12*c*, 12*d* when supported by them, as it will be described below, such as to securely assemble one common tower floor at a time.

Protection enclosure 130 comprises a protection enclosure main frame 132 which defines a plurality of access openings 146*a*, 146*b*, 148, 150. Indeed, FIG. 14A shows access openings 146*a* and 146*b*, where opening 146*a* relates to an upper building access and opening 146*b* relates to a lower building access. Furthermore, FIG. 14C shows access opening 148, which relates to a material access opening (such as to receive materials from hoisting equipment that will be needed to assemble common tower 10). FIG. 14C also shows access opening 150, which relates to a roll-up door access for a hoist car. As it will be described in more details below, protection enclosure main frame 132 is configured to releasably and slidably engage with spaced apart longitudinal grooves 30*a*, 30*b*, 30*c*, 30*d* defined in column hollow sections 24.

Protection enclosure 130 further comprises a roofing structure 134 which extends from protection enclosure main frame 132, as well as a plurality of lifting assemblies 136 (usually a number of lifting assemblies that corresponds to the number of spaced apart columns is provided). Each lifting assembly 136 is operatively coupled to protection enclosure main frame 132 and further to a corresponding spaced apart column 12*a*, 12*b*, 12*c* or 12*d*.

Referring now more particularly to FIGS. 15A, 15B and 15C, each lifting assembly 136 comprises an elongated jack 138 which defines a first jack end 137 and a second jack end 139. Assembly 136 further comprises an upper slider 140 connected to first jack end 137 and protection enclosure main frame 132 and further adapted to releasably and slidably engage with spaced apart longitudinal grooves 30*a*, 30*b*, 30*c*, 30*d*. Assembly 136 further comprises a lower slider 142 connected to second jack end 139 and further adapted to releasably and slidably engage with spaced apart longitudinal grooves 30*a*, 30*b*, 30*c*, 30*d*. It is to be mentioned that design of upper and lower sliders 140, 142 may look like design of above described slider 54, as they all need to slidably interreact with same longitudinal grooves 30*a*, 30*b*, 30*c*. 30*d*. Upper and lower sliders 140, 142 may therefore include a portion similar to longitudinal sliding surface 56 defined above. Upper and lower slider main bodies will however slightly differ from sliding member main body defined above as they need to interact with first and second jack ends 137, 139 of elongated jacks 138 or actuators instead of with main beam ends. Therefore, according to its configuration, when protection enclosure main frame 132 is supported by the spaced apart columns, via upper sliders 140, protection enclosure main frame 132 is capable of vertical displacement between a protection enclosure lower position (FIG. 15A) and a protection enclosure upper position (FIG. 15B), as lifting assemblies 136 may extend from a compressed position (FIG. 15A) to an extended position (FIG. 15B). Such vertical displacement provides to securely assemble/disassemble common tower 10 one floor at a time, as it will be described in more details below.

Indeed, FIGS. 16A-16E illustrate a method of erecting/assembling a common tower 10 using the common tower assembly described above, where protection enclosure 130 is releasably and slidably connected to the partly assembled spaced apart columns.

Figures 16A, 16B:
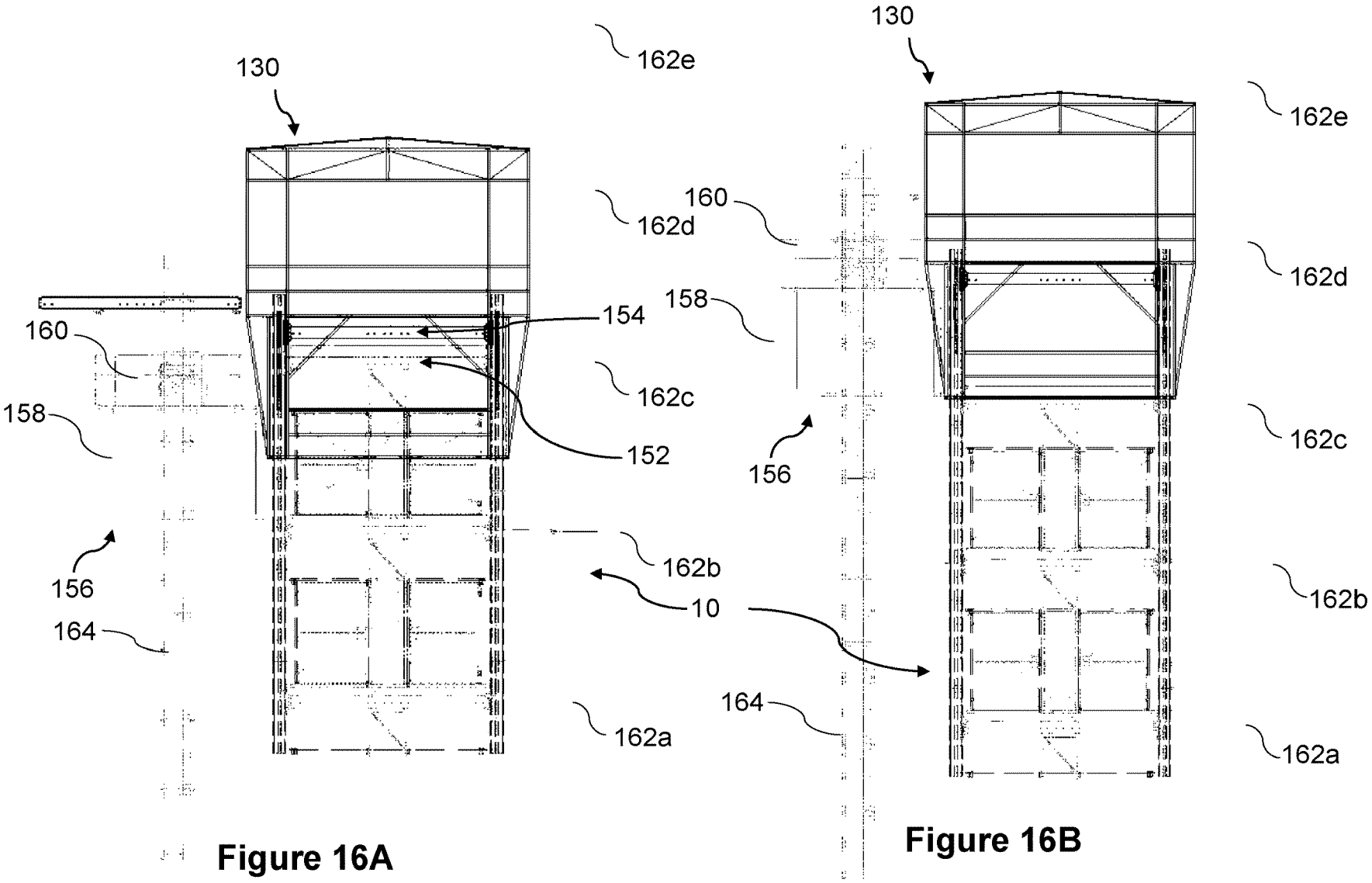
FIG. 16A illustrates a method of erecting a common tower using a common tower assembly, where the protection enclosure shown in FIGS. 14A-14G is releasably and slidably connected to the partly assembled spaced apart columns.
FIG. 16B illustrates a method of erecting a common tower using a common tower assembly, where the protection enclosure shown in FIGS. 14A-14G is releasably and slidably connected to the partly assembled spaced apart columns.

According to FIG. 16A, convey or hoist car 156, slidably and operatively mounted on crane 164 adjacent common tower 10 being assembled, brings material on common tower floor 154 being constructed. Hoist car enclosure 160 is provided above hoist car main frame 158 and configured to receive such material that will help in assembling common tower 10. Two already installed common tower floors, linked to building levels 162*a*, 162*b*, are shown in FIG. 16A (see common tower installed floor 152).

According to FIG. 16B, protection enclosure 130 is moved along spaced apart columns while providing lifting assemblies in their extended position (until bottom of protection enclosure main frame reaches flooring structure) so it protects the common tower floor being constructed. Additional column hollow sections may be aligned with, and connected to, the already installed column hollow sections.

Figure 16D:
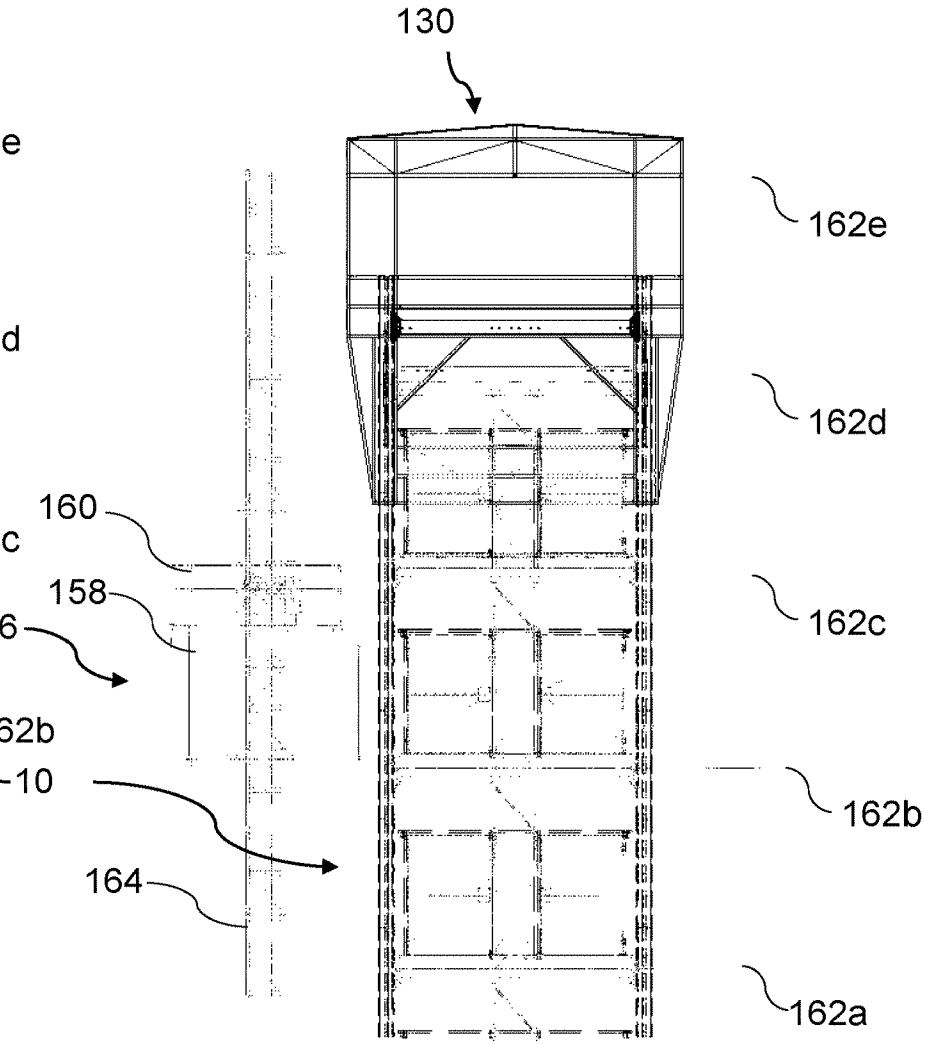
FIG. 16D illustrates a method of erecting a common tower using a common tower assembly, where the protection enclosure shown in FIGS. 14A-14G is releasably and slidably connected to the partly assembled spaced apart columns.
Figure 16C:
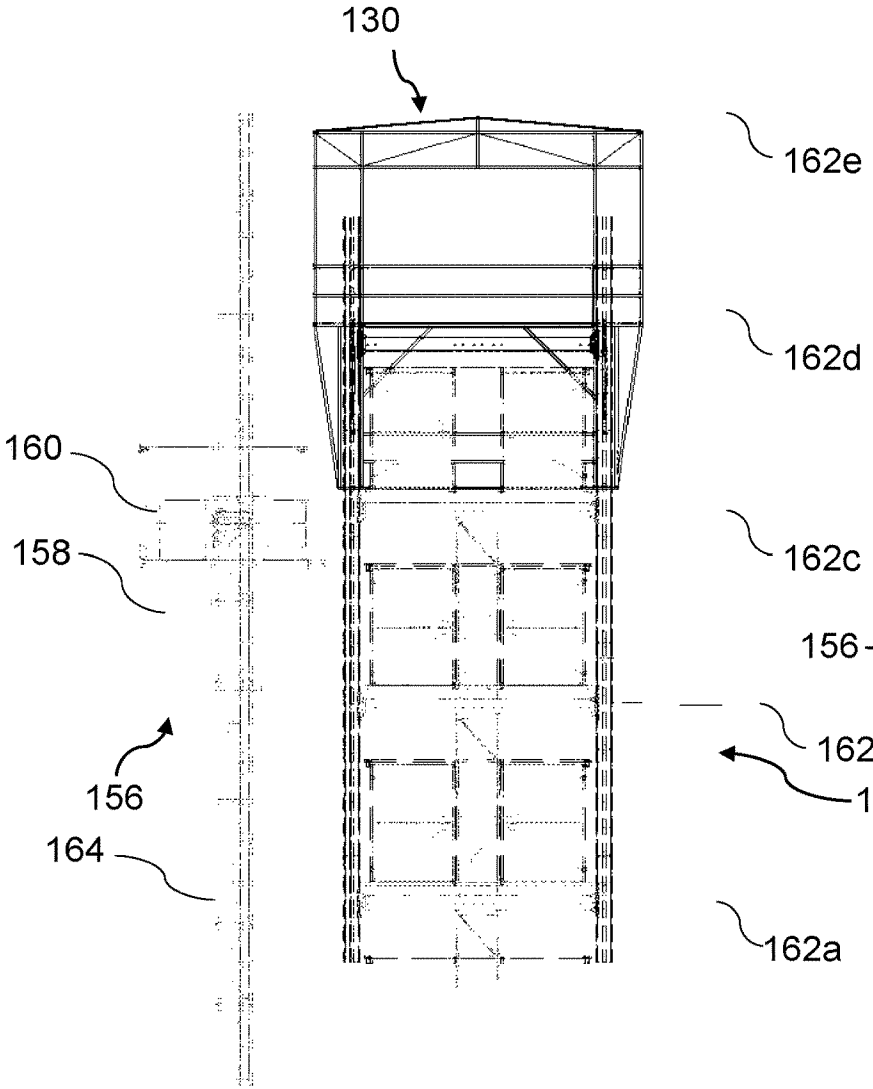
FIG. 16C illustrates a method of erecting a common tower using a common tower assembly, where the protection enclosure shown in FIGS. 14A-14G is releasably and slidably connected to the partly assembled spaced apart columns.

According to FIG. 16C, as required, column hollow sections are aligned with, and connected to, the already installed column hollow sections.

According to FIG. 16D, another deck supporting structure is releasably and slidably connected to the assembled column hollow sections forming the spaced apart columns, and further adjusted in height, so as it is possible to construct a new common tower floor.

Figure 16E:
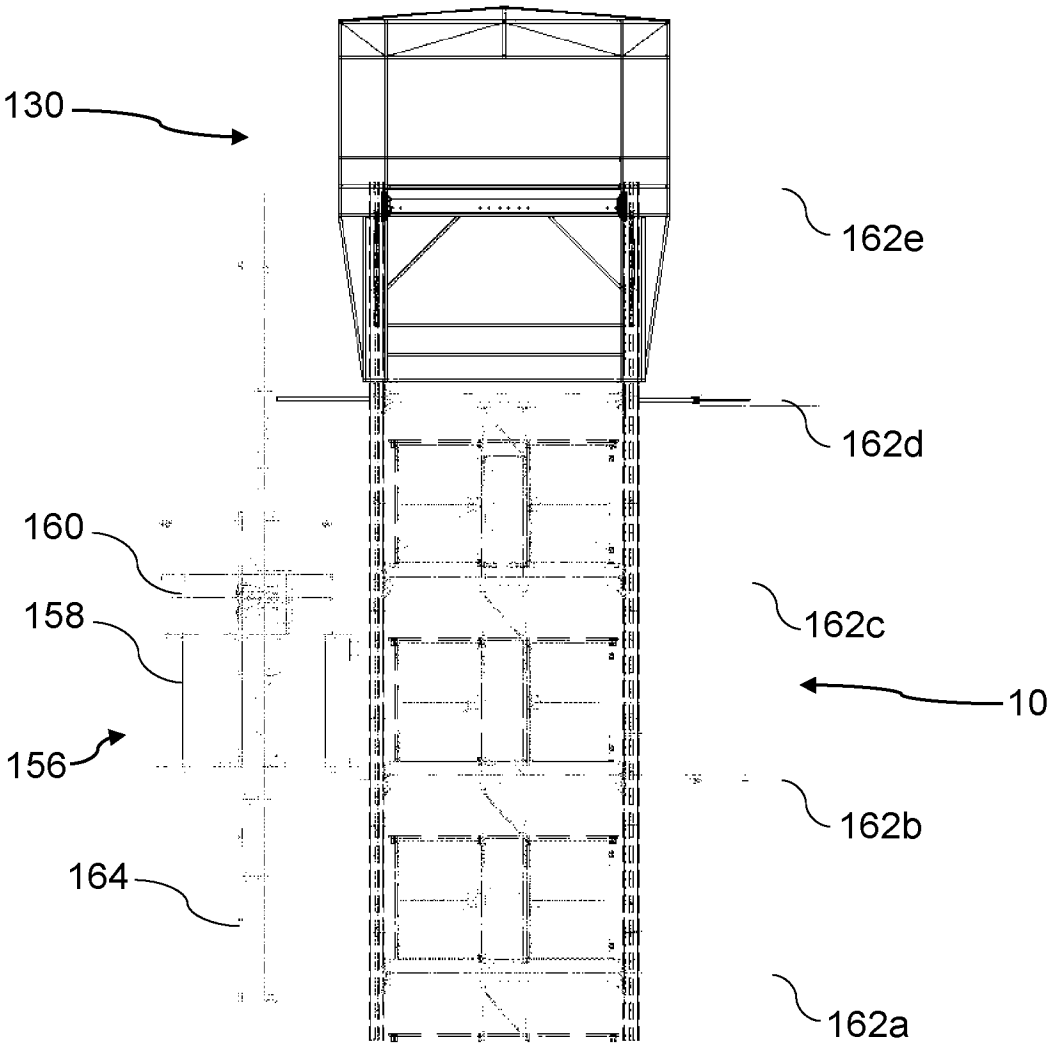
FIG. 16E illustrates a method of erecting a common tower using a common tower assembly, where the protection enclosure shown in FIGS. 14A-14G is releasably and slidably connected to the partly assembled spaced apart columns.

According to FIG. 16E, protection enclosure 130 is moved along spaced apart columns (until bottom of protection enclosure main frame reaches flooring structure) so it protects the common tower floor being constructed. Additional column hollow sections may be aligned with, and connected to, the already installed column hollow sections. Anchoring system may further be installed to engage with the building structure.

Protection enclosure 130 therefore allows to quickly and safely assembly/disassemble common tower 10, as it frames the common tower floor that is constructed, prior moving up to provide safe construction of an adjacent common tower floor.

While preferred embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. An assembly for erecting a common tower adjacent a building structure under construction, the assembly comprising:

spaced apart columns configured to be substantially vertically positioned adjacent the building structure, each column including a plurality of longitudinal grooves formed along an outer surface thereof, each longitudinal groove including a plurality of spaced apart openings formed therein along a length thereof;

vertically spaced apart flooring structures each including a plurality of primary beams having first and second ends, each of the first and second ends including spaced apart beam apertures formed therethrough; and a plurality of sliding members each including a groove formed through a center thereof and spaced apart apertures formed therethrough, a pin corresponding to each aperture, a longitudinal slide surface formed at one side thereof, and a pair of spring loaded pins disposed within the groove and extendable through the longitudinal slide surface, each sliding member being connectable to one of the first and second ends of the primary beams by inserting the first or second end of the primary beam into the groove of the sliding member to align the apertures of the sliding member and the apertures of the first or second end of the primary beam and inserting the corresponding pin through the aligned apertures to secure the sliding member to a respective first end or second end of the primary beam, wherein the vertically spaced apart flooring structures are slidably engageable with the spaced apart columns by inserting the longitudinal slide surface of each sliding member into one of the longitudinal grooves of a spaced apart column; and wherein the vertically spaced apart flooring structures are lockingly engageable along the spaced apart columns by extending the pair of spring loaded pins into two corresponding openings formed within the longitudinal grooves.

2. The assembly of claim 1, wherein each one of the spaced apart columns comprises:

a plurality of column hollow sections, each column hollow section being configured to be releasably connected to an adjacent one of the plurality of column hollow sections.

3. The assembly of claim 2, wherein each one of the spaced apart columns further comprises:

a plurality of column section-to-section connecting members, wherein each one of the plurality of column section-to-section connecting members is adapted to releasably engage one of the plurality of column hollow sections to the adjacent one of the plurality of column hollow sections.

4. The assembly of claim 3, wherein each one of the plurality of column section-to-section connecting members comprises:

a hollow main body defining a main body outer surface; and apertures formed within the hollow main body.

5. The assembly of claim 4, wherein the main body outer surface is adapted to interface with the inner surface of each one of the plurality of column hollow sections.

6. The assembly of claim 5, wherein each one of the plurality of column hollow sections defines a section first end and a section second end, the assembly further comprising:

base members adapted to receive the section first end and the section second end of the plurality of column hollow sections, and therefore adapted to support the spaced apart columns.

7. The assembly of claim 6, further comprising pin members adapted to releasably connect the one of the plurality of column hollow sections to the adjacent one of the plurality of column hollow sections using one of the plurality of column section-to-section connecting members by introducing each pin member in two of the spaced apart openings and further in two of the apertures to provide an end-to-end releasable connection between the one of the plurality of column hollow sections and the adjacent one of the plurality of column hollow sections.

8. The assembly of claim 1, wherein each one of the vertically spaced apart flooring structures further comprises secondary beam sections to be releasably connected to at least some of the primary beam sections for securing the primary beam sections together.

9. The assembly of claim 8, wherein each one of the vertically spaced apart flooring structures further comprises primary spaced apart floor supporting elongated members to be releasably connected to the primary beam sections.

10. The assembly of claim 9, wherein each one of the vertically spaced apart flooring structures further comprises flooring elements to be connected to the primary supporting elongated members.

11. The assembly of claim 10, further comprising:

a protection enclosure configured to be releasably and slidably supported by the spaced apart columns, the protection enclosure being configured to be capable of vertical displacement when supported by the spaced apart columns and comprising:

a protection enclosure main frame defining a plurality of access openings and configured to releasably and slidably engage with the spaced apart longitudinal grooves;

a roofing structure extending from the protection enclosure main frame; and lifting assemblies to be operatively coupled to the protection enclosure main frame and further to the spaced apart columns;

wherein when the protection enclosure main frame is supported by the spaced apart columns, the protection enclosure main frame is capable of vertical displacement between a protection enclosure lower position and a protection enclosure upper position when the lifting assemblies are extended from a compressed position to an extended position.

12. The assembly of claim 11, wherein each one of the lifting assemblies comprises:

an elongated jack defining a first jack end and a second jack end;

an upper slider adapted to be releasably connected to the first jack end and the protection enclosure main frame and further adapted to releasably and slidably engage with the spaced apart longitudinal grooves, and a lower slider adapted to be releasable connected to the second jack end and further adapted to releasably and slidably engage with the spaced apart longitudinal grooves at a distance from the upper slider.

13. The assembly of claim 1, further comprising:

protection structures configured to be connected to at least one of the spaced apart columns and the vertically spaced apart flooring structures, each one of the protection structures being adapted to surround the space above the flooring structures and comprising:

a plurality of horizontally oriented members and a plurality of vertically oriented members forming together a main frame defining a plurality of spaced apart access openings; and a meshed structure mounted on the main frame.

14. The assembly of claim 1, further comprising:

an anchoring system configured to be releasably connected to the vertically spaced apart flooring structures, the anchoring system being adapted to securely engage with the building structure to maintain the spaced apart columns substantially upright.

* * * * *